US007364449B2

(12) United States Patent
Makino

(10) Patent No.: US 7,364,449 B2
(45) Date of Patent: Apr. 29, 2008

(54) JOINT CONNECTOR BLOCK

(75) Inventor: Masahiro Makino, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/556,358

(22) PCT Filed: Apr. 8, 2004

(86) PCT No.: PCT/JP2004/005058

§ 371 (c)(1),
(2), (4) Date: Nov. 10, 2005

(87) PCT Pub. No.: WO2004/102746

PCT Pub. Date: Nov. 25, 2004

(65) Prior Publication Data

US 2007/0010112 A1 Jan. 11, 2007

(30) Foreign Application Priority Data

May 15, 2003 (JP) ..... 2003-137295

(51) Int. Cl.
*H01R 4/60* (2006.01)

(52) U.S. Cl. ..... 439/212; 439/76.2; 439/213; 439/721

(58) Field of Classification Search ..... 439/76.2, 439/212, 213, 721
See application file for complete search history.

(56) References Cited

U.S. PATENT DOCUMENTS 4,895,532 A * 1/1990 Bogese, II ..... 439/507
5,007,888 A * 4/1991 Goutiere ..... 439/189
5,160,274 A * 11/1992 Ozaki et al. ..... 439/212
5,626,492 A * 5/1997 Onizuka et al. ..... 439/512
6,368,128 B1 * 4/2002 Backer et al. ..... 439/189
6,910,923 B2 * 6/2005 Nakanishi ..... 439/620.26

FOREIGN PATENT DOCUMENTS

JP 7-147718 6/1995

* cited by examiner

*Primary Examiner*—Tho D. Ta
*Assistant Examiner*—Travis Chambers
(74) *Attorney, Agent, or Firm*—Kratz, Quintos & Hanson, LLP

(57) ABSTRACT

A joint connector block, which easily meets a demand of a complicated and highly dense joint circuit, is provided. It includes: a block body 2 having a plurality of connector-fitting chambers 7 arranged in a line on one side of the block body and a busbar-receiving part 2*b* communicating with the connector-fitting chambers on an opposite side of the block body; a plurality of longitudinal busbars 3, each of which includes at least one branch terminal 24 projecting in the connector-fitting chamber and at least one pair of clip terminals 23 situated on the side of the busbar-receiving part; and a plurality of lateral busbars 4, each of which includes at least one branch terminal 26 projecting in the connector-fitting chamber and a connecting part 25 to be connected to the pair of the clip terminals 23 on the side of the busbar-receiving part, the lateral busbar being connected to the longitudinal busbar crossing the longitudinal busbar at right angles.

20 Claims, 14 Drawing Sheets

JOINT CONNECTOR BLOCK

TECHNICAL FIELD

The present invention relates to a joint connector block which executes joint-connection by crossing busbars extending in longitudinal and lateral directions.

BACKGROUND ART

FIG. 24 shows an example of a conventional joint connector block (referring to Japanese Utility Model Application Laid-Open No. H5-29230).

The joint connector block 51 includes: an upper casing 52 made of synthetic resin; lower casing 53 made of synthetic resin; and a plurality of busbars 54, each of which includes terminals and is arranged in a line in the lower casing 53. Each upward tab terminal 55 of the corresponding busbar 54 projects in a corresponding connector housing 56 of the upper casing 52, thereby enabling a connector (outside connector) of an external wiring harness to be coupled with a connector consisting of the tab terminals 55 and the connector housing 56.

A plurality of the tab terminals 55 are arranged forming a line in the longitudinal direction of the corresponding busbar 54. Each tab terminal 55 projects in the corresponding connector housing 56, thereby joint-connecting each outside connector to the connector consisting of the tab terminals 55 and the connector housing 56 through the corresponding busbar 54. Thereby, electric power circuits or ground circuits of the outside connector are electrically connected. The joint connector block 51 is mounted on a motor vehicle and so on.

However, since the busbars 54 are arranged in a line forming a plurality of lines in the conventional joint connecter block 51, the positions of tab terminals 55 for joint-connecting corresponding outside connectors and positions of female terminals for joint-connection in the corresponding outside connectors are limited, causing difficulty for meeting a demand of a complicated circuit structure and difficulty for meeting a demand of a different circuit form varying depending on types of vehicle, and causing a problem that the joint connector block 51 must be designed and manufactured per a type of vehicle every time.

For example, Japanese Patent Application Laid-Open No. H7-147718 proposes a busbar structure (not shown in a figure) of an electric junction box, in which connectors are joint-connected with each other by arranging busbars in two directions, i.e. in the longitudinal and lateral directions. However, in this structure, when an outside connector is to be joint-connected, similarly to Japanese Utility Model Application Laid-Open No. H5-29230, only a tab terminal of a busbar extending in one direction is used to joint-connect the connector to the outside connector, causing difficulty for meeting a demand of a complicated and highly dense circuit form and difficulty for meeting a demand of a different circuit form which varies depending on types of vehicle.

DISCLOSURE OF INVENTION

It is therefore an objective of the present invention to solve the above problems and to provide a joint connector block, which can easily meet a demand of a complicated and highly dense joint circuit form or a demand of a different joint circuit form which varies depending on types of vehicle.

In order to attain the above objective, a joint connector block of the present invention defined in claim 1 is a joint connector block comprising:

a block body having a plurality of connector-fitting chambers arranged in a line on one side of the block body and a busbar-receiving part communicating with the connector-fitting chambers on an opposite side of the block body;

a plurality of longitudinal busbars, each of which includes at least one branch terminal projecting in the connector-fitting chamber and at least one pair of clip terminals situated on the side of the busbar-receiving part; and a plurality of lateral busbars, each of which includes at least one branch terminal projecting in the connector-fitting chamber and a connecting part to be connected to the pair of the clip terminals on the side of the busbar-receiving part, the lateral busbar being connected to the longitudinal busbar crossing the longitudinal busbar at right angles.

With the construction described above, the longitudinal busbars are mounted in the block body and thereafter the lateral busbars are mounted therein, thereby the connecting part of the lateral busbar is inserted in and connected to the clip terminals of the longitudinal busbars. Thereby, the longitudinal and lateral busbars are connected to each other. Each longitudinal or lateral busbar is mounted to a required position in a required form. When each longitudinal or lateral busbar is mounted in the block body, each branch terminal of each busbar is simultaneously positioned projecting in the connector-fitting chamber. Each branch terminal of each busbar is arranged in a line in the connector-fitting chamber. Each branch terminal is arranged in a matrix shape. Connectors of the outside wiring harness are inserted in the connector-fitting chamber. The outside wiring harness (plurality of electric wires) is joint-connected by the branch terminals of the longitudinal and lateral busbars.

A joint connector block of the present invention defined in claim 2 is, in the joint connector block as described in claim 1, characterized in that the busbar-receiving part includes:

a plurality of slit grooves, each of which receives the longitudinal busbar; and a plurality of lateral slits, each of which engages with the connecting part of the lateral busbar, the lateral slit crossing the slit groove at right angles.

With the construction described above, the longitudinal busbars are inserted in the slit groove and positioned, while the branch terminals of the lateral busbars are inserted. The branch terminals of the longitudinal and lateral busbars are arranged in a line. Each branch terminal is entered into the connector-fitting chamber through the slit groove. The slit groove is positioned crossing the connector-fitting chamber at right angles. Each slit groove is formed between the partition walls. The connecting part of the lateral busbar enters into a shallow lateral slit of the partition wall so as to be positioned without backlash and simultaneously the connecting part is clipped by and connected to the pair of the clip terminals of the longitudinal busbar. The lateral slits are arranged in a line with the same pitch as that of the connector-fitting chamber.

A joint connector block of the present invention defined in claim 3 is, in the joint connector block as described in claim 2, characterized in that a concave groove is formed in a partition wall of the connector-fitting chamber continuously from the lateral slit, the branch terminal of each said longitudinal or lateral busbar being inserted through the concave groove.

With the construction described above, Each branch terminal of the longitudinal or lateral busbar is positioned in the concave groove of the partition wall which is adjacent to the slit groove and projects in the connector-fitting chamber with an accurate pitch.

A joint connector block of the present invention defined in claim 4 is, in the joint connector block as described in any one of claims 1-3, characterized in that the branch terminal of the longitudinal busbar is offset in a direction crossing at right angles from a connection part from which the pair of the clip terminals protrudes, while the branch terminal of the lateral busbar is on the same plane as that of the connection part of the lateral busbar.

With the construction described above, the branch terminal of the longitudinal busbar is offset in a direction crossing at right angles and the branch terminal of the lateral busbar projects from the same plane as that of the connection part of the lateral busbar so as to be arranged crossing the longitudinal busbar at right angles, thereby each branch terminal of the longitudinal or lateral busbar is arranged in parallel (in a line) and is arranged in a slit groove or in a connector-fitting chamber being intermingled.

A joint connector block of the present invention defined in claim 5 is, in the joint connector block as described in any one of claims 1-4, characterized in that a plurality of ribs are projectingly formed on a partition wall of the connector-fitting chamber, the rib insulating the branch terminals of each said longitudinal or lateral busbar from each other.

With the construction described above, the branch terminals of each said longitudinal or lateral busbar are insulated from each other by the rib in the connector-fitting chamber and protected from an interference and so on.

A joint connector block of the present invention defined in claim 6 is, in the joint connector block as described in any one of claims 1-5, characterized in that each end of the pair of the clip terminals protrudes outward from the busbar-receiving part.

With the construction described above, the connecting part of the lateral busbar is easily inserted in and connected to the pair of the clip terminals of the longitudinal busbar, enabling visual observation for confirming a connection between both busbars. A joint connector block of the present invention defined in claim 7 is, in the joint connector block as described in any one of claims 1-6, characterized in that a cover is fitted to the block body and each said longitudinal or lateral busbar abuts against the cover, thereby preventing each busbar from slipping out.

With the construction described above, the cover prevents each busbar from slipping out, thereby attaining no need to engage each busbar with the block body.

A joint connector block of the present invention defined in claim 8 is, in the joint connector block as described in claim 7, characterized in that the cover includes: a plurality of ribs against each of which an end of each said pair of the clip terminals abuts; and a plurality of grooves, each of which is formed between the ribs, the connection part of the lateral busbar entering in said groove.

With the construction described above, the end of the pair of the clip terminals of the longitudinal busbar abuts against an end face of the rib and is positioned in the longitudinal direction of the terminal being prevented from slipping off. The end part of the connecting part of the lateral busbar engages with the groove between the ribs so as to be positioned in a plate-thickness direction of the busbar, thereby the end of the connecting part abuts against the bottom of the groove so that the lateral busbar is positioned in the longitudinal direction and prevented from slipping off.

A joint connector block of the present invention defined in claim 9 is, in the joint connector block as described in claim 8, characterized in that said groove is provided with an inclined shaped guide surface on the inlet side of the groove.

With the construction described above, the connecting part of the lateral busbar slides along the guide surface and enters into the groove, thereby the connecting part is securely inserted into the groove and the cover is securely mounted.

A joint connector block of the present invention defined in claim 10 is, in the joint connector block as described in any one of claims 1-9, characterized in that each said longitudinal or lateral busbar is formed by cutting a laterally linked terminal into a required shape.

With the construction described above, the laterally linked terminal is cut into a required shape (i.e. numbers or arrangement of each terminal, or length of the busbar) according to a specification of a circuit so as to easily make the longitudinal and lateral busbars required.

A joint connector block of the present invention defined in claim 11 is, in the joint connector block as described in claim 10, characterized in that an unnecessary pair of the clip terminal or branch terminal is cut off from the connecting part of the longitudinal or lateral busbar, and/or the connecting part is cut into a required length or cut at a required position.

With the construction described above, by cutting off an unnecessary pair of the clip terminal of the longitudinal busbar, a connection with the lateral busbar is partially cut. By cutting off an unnecessary branch terminal of the longitudinal or lateral busbar, it becomes possible to meet a demand of a circuit of the outside wiring harness, said circuit including a part not to be connected. Further, for example, an unnecessary branch terminal of the longitudinal busbar is cut off, then the branch terminal of the lateral busbar is arranged on the cut portion, thereby enabling to meet a demand of a complicated joint circuit.

BEST MODE FOR CARRYING OUT THE INVENTION

In the following, the preferred embodiments of the present invention will be explained in detail with reference to the attached drawings.

Figure 1:
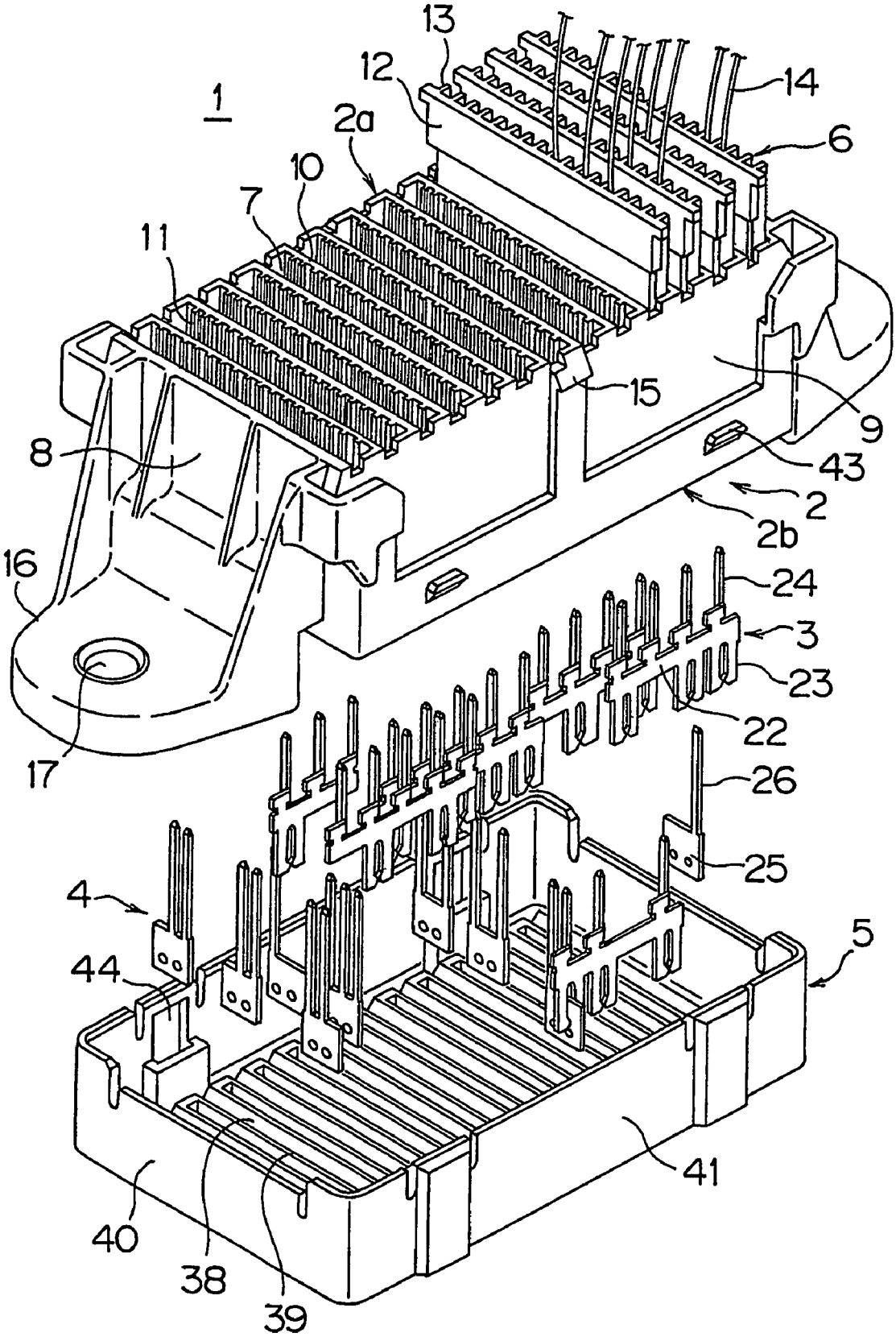
FIG. 1 is an exploded perspective view illustrating a preferred embodiment of a joint connector block according to the present invention.

FIG. 1 shows a preferred embodiment of a joint connector block according to the present invention.

The joint connector block 1 includes: a block body 2 (main cover or casing) made of electrically insulating resin; a plurality of longitudinal busbars 3 and a plurality of lateral busbars 4; and a lower cover 5 (cover) made of insulating resin for preventing each busbar 3, 4 from coming off, wherein each busbar 3, 4 is made of electrically conductive metal, includes at least one terminal, and is to be inserted in the block body 2 from the bottom. A plurality of outside connectors 6 are inserted in the joint connector block 1 from the top.

The block body 2 includes connector-fitting parts 2*a* situated at its upper half and busbar-receiving parts 2*b* situated at its lower half. The connector-fitting part 2*a* includes a plurality of thin (long and narrow) connector-fitting chambers 7 arranged in a line. Each connector-fitting chamber 7 is formed being partitioned by vertical partition walls 10 with the same pitch in the inside of outer walls 8, 9 situated in front and behind, and left and right. Each partition wall 10 and the outer wall situated behind are projectingly provided with a plurality of ribs 11 with the same pitch. A space 7 (as a substitute use of the reference numeral) for receiving a terminal is formed between the adjacent ribs 11. The projection length of each rib 11 is short. Each partition wall 13 of a housing 12 made of insulating resin of the outside connector 6 is positioned mating (facing) with the corresponding rib 11.

A female terminal (not shown in the figure) is engagingly received in between the adjacent partition walls 13 of the outside connector 6. The female terminal is crimp-connected to an electric wire 14. The housing 12 is formed in a thin shape with a wide board 12 (as a substitute use of the reference numeral) and a plurality of the partition walls 13 arranged in the same pitch. The housing 12 and the female terminals constitute the outside connector 6. The wires 14 and the outside connectors 6 constitute a wiring harness. Each outside connector 6 is inserted in up to a face position flush with the upper end face of the block body 2 (FIG. 1 illustrating an intermediate insertion state of the outside connector 6) and fixed in a lump to the block body 2 with a long engaging member (not shown in the figure) made of synthetic resin. A reference numeral 15 indicates an engaging projection which engages with the engaging member described above.

The block body 2 is integrally provided with a bracket 16 at its end in its longitudinal direction. The bracket 16 is clamped and fixed on a vehicle body and so on by inserting a bolt through a hole 17 of the bracket 16.

Figure 2:
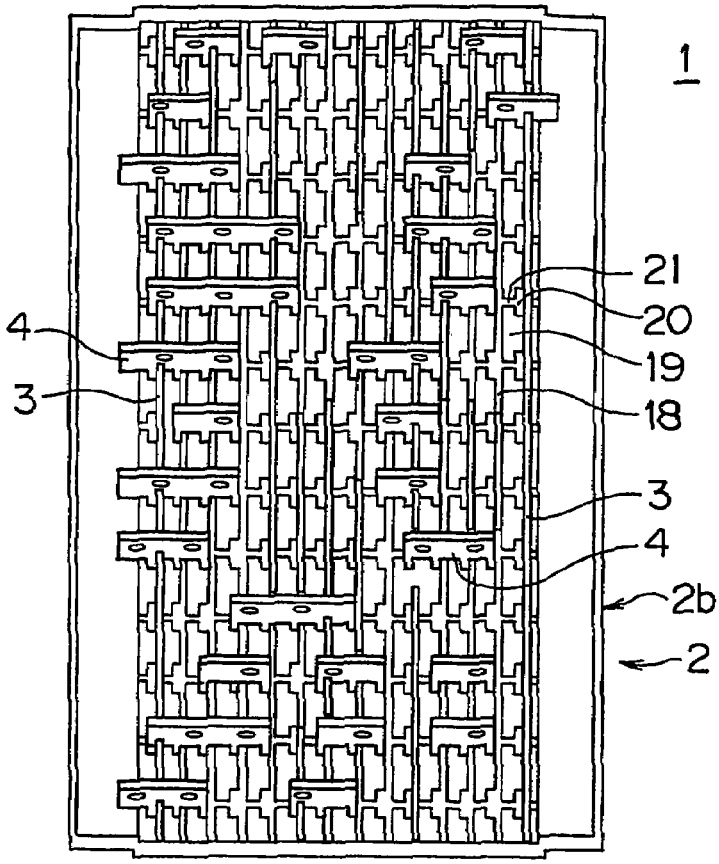
FIG. 2 is a perspective view, which is almost a plan view, illustrating a state when each busbar is mounted on a block body.
Figure 3:
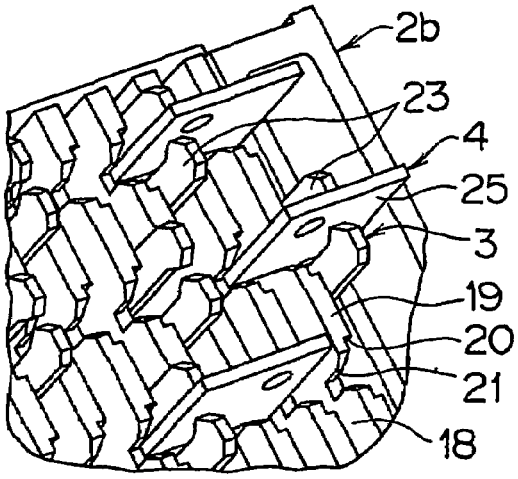
FIG. 3 is a perspective view of a primary part illustrating a connection state of each busbar.

As shown in FIGS. 2 and 3 (view from the bottom), in the busbar-receiving part 2*b* situated at the lower half of the block body 2, there are provided a plurality of slit grooves 18 extending in the longitudinal direction of the block body 2 arranged in a line with the same pitch. A plurality of concave grooves 20, which is perpendicular to a plurality of vertical partition walls 19 that constitute the slit grooves 18 and are arranged in a line, are formed being arranged in a line with the same pitch in the longitudinal direction of the block body 2. Each concave groove 20 is arranged in a line in a direction crossing the longitudinal direction of the block body 2 at right angles. Each short vertical lateral slit 21 is formed with the same pitch at the lower end of the corresponding concave groove 20. A plurality of the slit grooves 18 and a plurality of the lateral slits 21 (the concave grooves 20) cross at right angles each other being positioned in a matrix shape. The lateral slit 21 communicates with the slit grooves 18 situated left and right thereof in the crossing direction.

Each longitudinal busbar 3 including at least one terminal is arranged in the slit groove 18, while each lateral busbar 4 including at least one terminal is arranged along the lateral slit 21, and both busbars 3 and 4 are positioned crossing at right angles (being connected) or being independent (separated) from each other.

As shown in FIG. 1, each longitudinal busbar 3 includes: a band plate-shaped connecting part 22 that is a main body of the busbar 3; at least one pair of clip terminals 23 (tuning fork-shaped terminal) projecting downward from the connecting part 22; and at least one pin-shaped terminal 24 (branch terminal) projecting upward with crossing the connecting part 22 at right angles. Each lateral busbar 4 includes: a plate-shaped connecting part 25 that is a main body of the busbar 4; and at least one pin-shaped terminal 26 (branch terminal) projecting upward from the connecting part 25.

Figure 5:
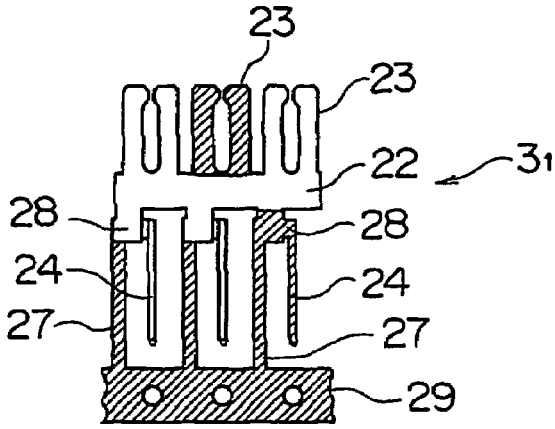
FIG. 5 is a plan view illustrating a preferred embodiment of cutting processing of a longitudinal busbar.
Figure 4:
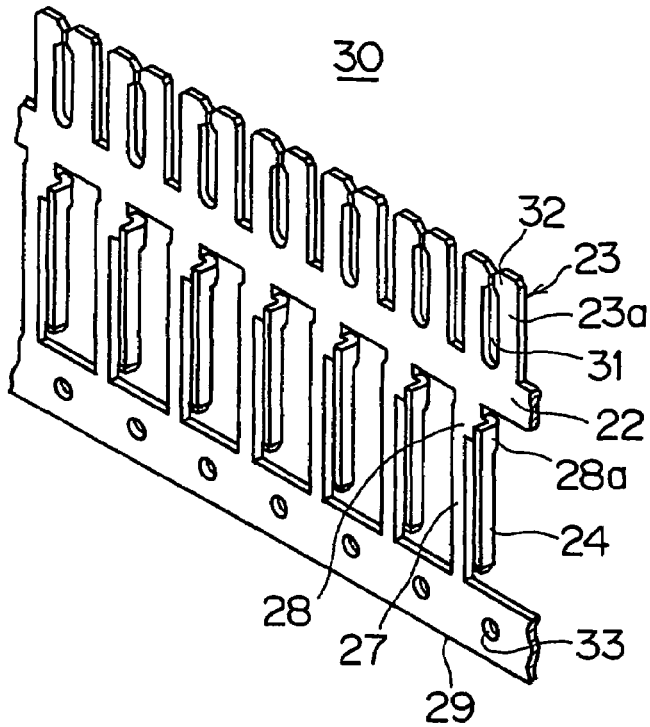
FIG. 4 is a perspective view illustrating a preferred embodiment of a longitudinal busbar (intermediate processed good).
Figure 6:
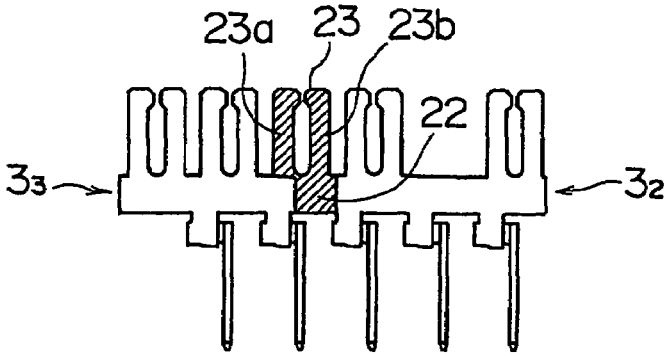
FIG. 6 is a plan view illustrating another preferred embodiment of cutting processing of a longitudinal busbar.
Figure 7:
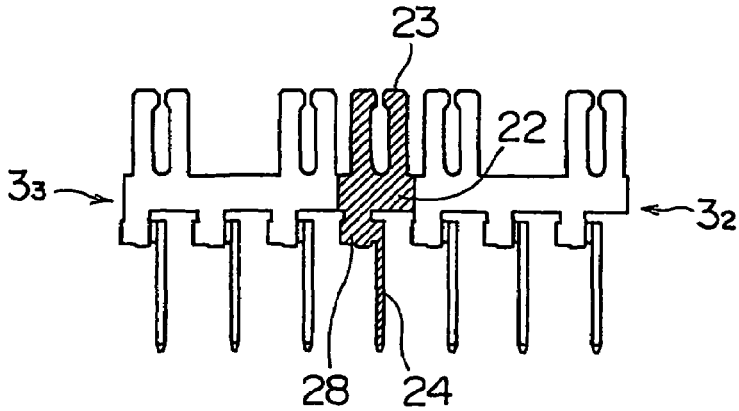
FIG. 7 is a plan view illustrating a further preferred embodiment of cutting processing of a longitudinal busbar.

As shown in FIG. 4, the longitudinal busbar 3 is formed by stamping and bending one sheet of electrically conductive metal and thereafter, as shown in FIGS. 5-7, by cutting into a required shape.

As shown in FIG. 4, in the stamping and bending steps, formed is a laterally linked terminal 30 (intermediate processed good of the longitudinal busbar) including: a first connecting part 22 extending perpendicular to the horizontal direction; pairs of clip terminals 23 standing up from the first connecting part 22 with the same pitch; vertical and thin linking part 27 extending in the extending direction of one clip piece 23*a* of a pair of the clip terminals 23 from the first connecting part 22; pin-shaped terminals 24 continuing to and crossing one end of a little wide part 28 (second connecting part) on the base side of the linking part 27; and a linked band 29 crossing the linking part 27 and continuing therefrom extending in the horizontal direction.

The pin-shaped terminal 24 is arranged on a position where the position of a slot 31 situated between the pair of the clip terminals 23 is shifted in its longitudinal direction. Each clip terminal 23 has an arc-shaped contact 32 on the inner side of its end. A pair of the contacts 32 is positioned having a small distance therebetween. The pair of the clip terminals 23 is known as itself. The second connecting part 28 includes a part 28*a* bent at right angles. The pin-shaped terminal 24 is offset in a direction crossing at right angles from the connecting part 22 by the bent part 28*a*. The linking part 27 and the linked band 29 are cut off in a later step. Holes 33 formed in the linked band 29 are for perforation upon the processing.

Cutting processing (cutting of a portion indicated with inclined lines) shown in FIGS. 5-7 are carried out optionally according to a circuit form.

In an example of processing shown in FIG. 5, the linking part 27 and the linked band 29 are integrally cut off from an end of the second connecting part 28. An unnecessary pin-shaped terminal 24, linking part 27 and second connecting part 28 are cut off. An unnecessary pair of the clip terminals 23 is cut off from the base. The first connecting part 22 is cut into a required length. Thereby, formed is a longitudinal busbar 31 including: two pairs of the clip terminals 23 having no pair therebetween on one side of the first connecting part 22; and two pin-shaped terminals 24 adjacent to each other on an opposite side of the first connecting part 22.

In an example of processing shown in FIG. 6, a middle pair of the clip terminals 23 is removed together with the first connecting part 22, thereby forming divided longitudinal busbars 32 and 33. One clip piece 23*a* of the middle pair of the clip terminals 23 is cut except the first connecting part 22, while another clip piece 23*b* is cut off together with the first connecting part 22.

In an example of processing shown in FIG. 7, a middle pair of the clip terminals 23 is removed together with the first and second connecting parts 22, 28 and a pin-shaped terminal 24, thereby forming divided identical longitudinal busbars $\mathbf{3}_2$. In FIGS. 6 and 7, another middle pair of the clip terminals 23 is also removed.

The processing of the longitudinal busbar 3 is not limited to the embodiments shown in FIGS. 5-7 and is carried out according to a circuit form.

Figure 8:
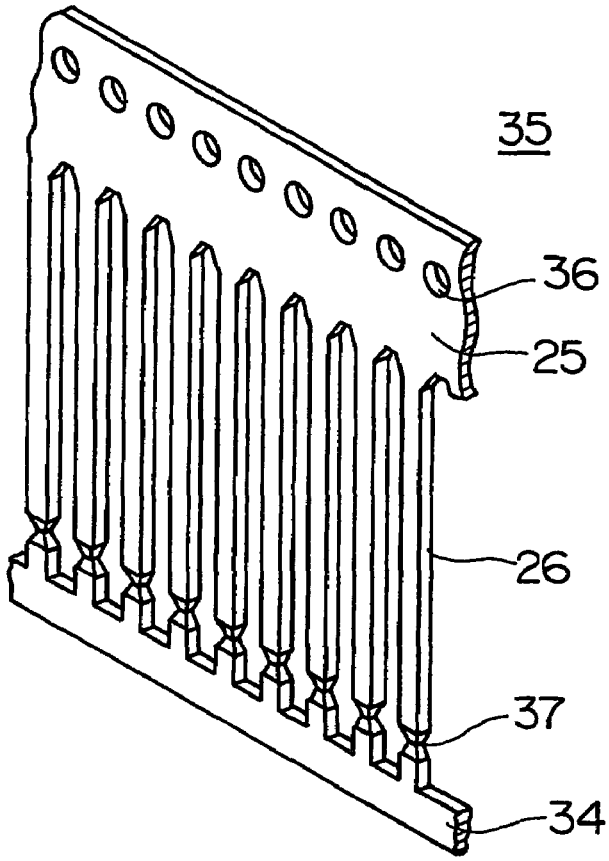
FIG. 8 is a perspective view illustrating a preferred embodiment of a lateral busbar (intermediate processed good).
Figure 9:
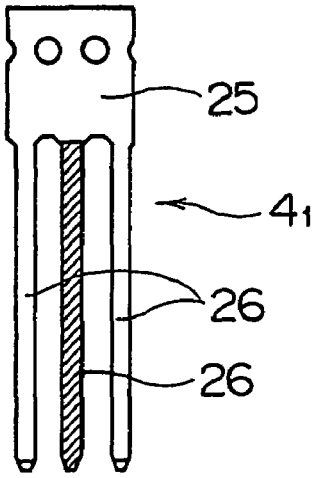
FIG. 9 is a plan view illustrating a preferred embodiment of cutting processing of a lateral busbar.
Figure 10:
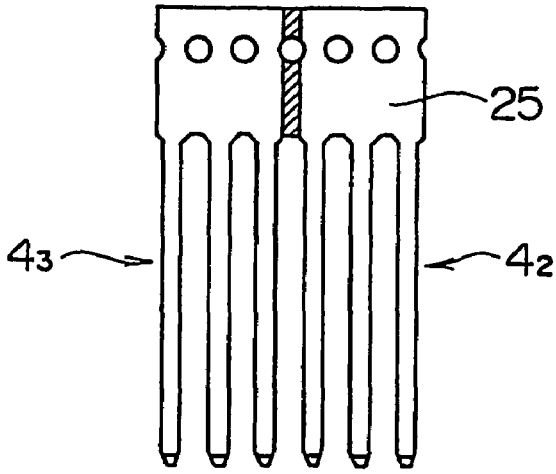
FIG. 10 is a plan view illustrating another preferred embodiment of cutting processing of a lateral busbar.

FIGS. 8-10 show embodiments of the processing of the lateral busbar 4.

As shown in FIG. 8, formed is a laterally linked terminal 35 (intermediate processed good of the lateral busbar) including: a plate-shaped connecting part 25 stamped from one sheet of electrically conductive metal; a plurality of pin-shaped terminals 26 projecting from a plane of the connecting part 25 with the same pitch; and a linked band 34 for connecting ends of the pin-shaped terminals 26.

The connecting part 25 is provided with holes 36 for perforation upon the processing arranged with the same pitch. The hole 36 is not needed for the joint-connection, therefore if the processing of the pin-shaped terminal 26 is possible, the hole 36 may be removed. The linked band 34 is connected to an end of the pin-shaped terminal 26 through a small-diameter notch 37 and is easily removed by bending.

In an example of processing shown in FIG. 9, a middle pin-shaped terminal 26 is cut from the connecting part 25, thereby forming a lateral busbar $\mathbf{4}_1$ having no terminal at the middle. A pin-shaped terminal 26 situated at the end may be cut off (see reference numeral 42 in FIG. 1). In each case, the corresponding terminal should be cut off from the base (root) thereof so as to leave the connecting part 25. The connecting part 25 acts as a contact (plate-shaped electric contact) to the longitudinal busbar 3. The pin-shaped terminal 26 of the lateral busbar 4 is formed longer than the pin-shaped terminal 24 of the longitudinal busbar 3. The thickness, width, thickness-direction and width-direction are the same between the two pin-shaped terminals 24 and 26.

In an example of processing shown in FIG. 10, the connection part 25 is cut at the middle so as to be divided into two short lateral busbars $\mathbf{4}_2$ and $\mathbf{4}_3$. The processing of the lateral busbar 4 is not limited to the embodiments shown in FIGS. 9-10 and is carried out according to a circuit form.

These longitudinal and lateral busbars 3, 4 are connected to each other crossing at right angles in the block body 2 as shown in FIGS. 1-3. The receiving process of the longitudinal busbars 3 and the insertion process of the lateral busbars 4 are carried out by reversing the block body. That is, as shown in FIG. 2, the longitudinal busbars 3 are received in the respective slit grooves 18 of the block body 2, and as shown in FIG. 3, the end of the pair of the clip terminals 23 is positioned projecting outward from the slit groove 18.

Figure 11:
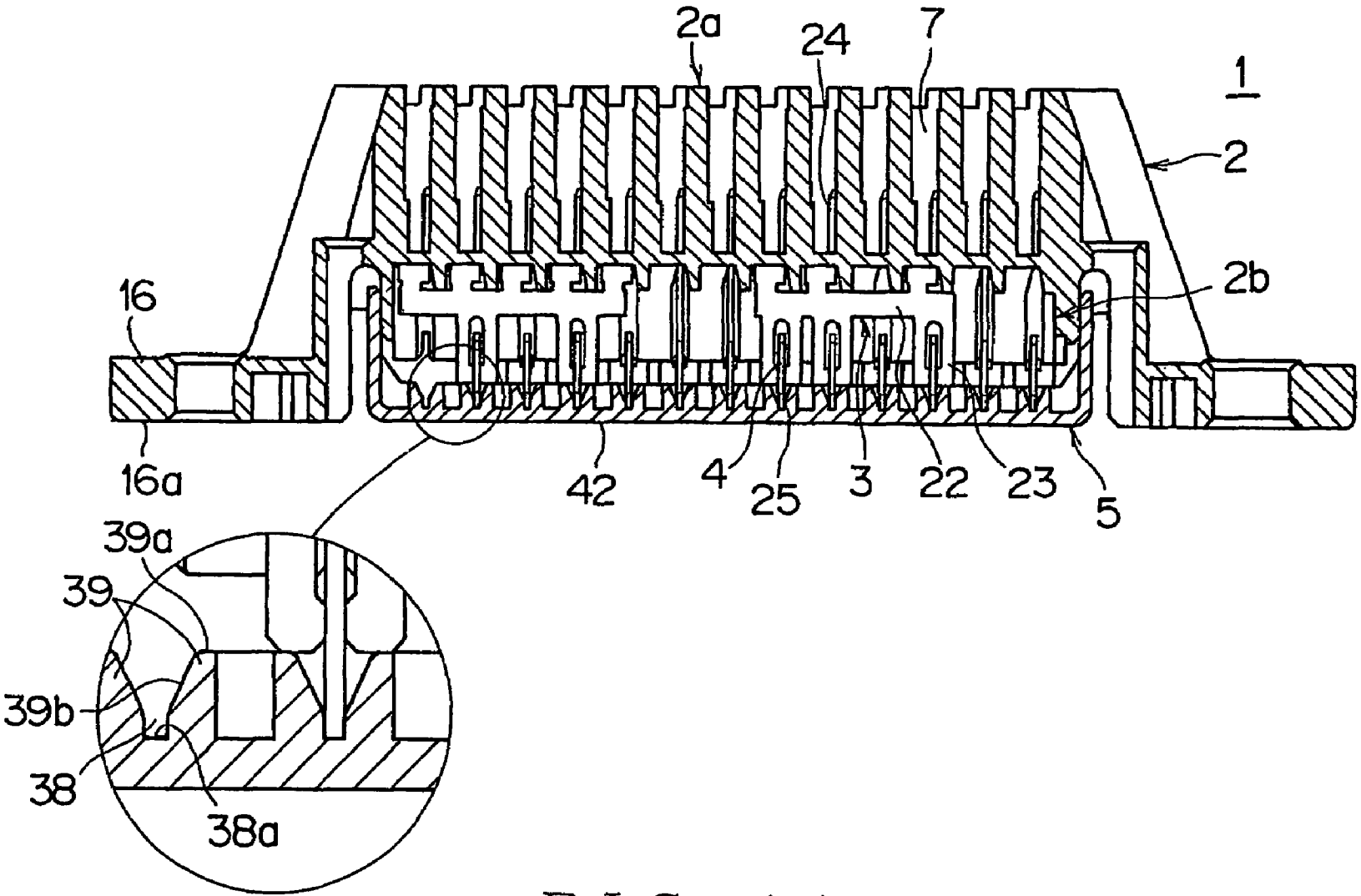
FIG. 11 is a longitudinal sectional view illustrating a state when a lower cover is mounted on a block body in which each busbar is received.

As shown in FIG. 11, the pin-shaped terminal 24 of the longitudinal busbar 3 is positioned projecting in the connector-fitting chamber 7 situated in the upper half of the block body 2. Since the pin-shaped terminal 24 crosses the connecting part 22 at right angles (a little projecting in the direction of crossing at right angles), the pin-shaped terminal 24 passes through the concave groove 20 of the partition wall 19 and projects in the connector-fitting chamber 7.

After the longitudinal busbars 3 are inserted, as shown in FIGS. 2-3, the lateral busbars 4 are inserted in the block body 2 simultaneously being connecting to the longitudinal busbars 3 crossing the longitudinal busbars 3 at right angles. That is, the pin-shaped terminal 26 (see FIG. 1) of the lateral busbar 4 passes through the concave groove 20, which crosses the slit groove 18 (see FIG. 2) of the block body 2 at right angles, projects in the connector-fitting chamber 7 situated in the upper half of the block body 2, and is positioned in parallel to the pin-shaped terminal 24 (see FIG. 1) of the longitudinal busbar 3. Each pin-shaped terminal 24, 26 is isolated from each other by the rib 11 in the connector-fitting chamber 7.

When the pin-shaped terminal 26 is inserted, simultaneously the base side of the connecting part 25 (see FIG. 3) of the lateral busbar 4 is connected to (clipped by) the pair of the clip terminals of the longitudinal busbar 3. The base side of the connecting part 25 of the lateral busbar 4 is entered into the lateral slit 21 and positioned tightly, thereby securing the joint-connection between both busbars 3, 4 without a positional shift. As shown in FIG. 3, the connecting part 25 of the lateral busbar 4 is positioned projecting a little higher than the pair of the clip terminals 23 of the longitudinal busbar 3. The ends of the pin-shaped terminals 24, 26 (see FIG. 1) are positioned at the same height.

After both busbars 3, 4 are mounted in the block body 2, as shown in FIG. 11, the lower cover 5 is mounted on the block body 2, thereby preventing each busbar 3, 4 from slipping off.

As shown in FIGS. 1 and 11, the lower cover 5 includes a plurality of grooves 38 arranged in a line with the same pitch in the arrangement direction of the connector-fitting chambers. Each groove 38 is constituted with pairs of ribs 39 on both sides thereof. An end of the connecting part 25 of the lateral busbar 4 is inserted in the groove 38. The end of the connecting part 25 abuts against a bottom face 38*a* of the groove 38 and is supported there. The end of the pair of the clip terminals 23 of the longitudinal busbar 3 abuts against an end face 39*a* of the rib 39 and is supported there. A taper-shaped guide face 39*b* is formed on the entrance side of the groove 38. The connecting part 25 of the lateral busbar 4 is smoothly inserted along the guide face 39*b*. The connecting part 25, which is a connecting portion of the lateral busbar 4, is accurately positioned with the groove 38, thereby securing the contact with the pair of the clip terminals 23.

The pitch of each groove 38 is the same as the pitch of each connector-fitting chamber and the pitch of each lateral slit 21 (the pitch of each concave groove 20). The pitch of each rib 39 is the same as the pitch of each slit groove 18. The projecting length of the connecting part 25 from the end of the pair of the clip terminals 23 is the same as the depth of the groove 38.

As shown in FIGS. 1 and 11, the lower cover 5 includes walls 40-42 located in front and behind, and left and right, and at the bottom. The grooves 38 and ribs 39 are formed on the inner side of the wall 42 located at the bottom. Each wall 41 situated left or right of the lower cover 5 is provided with a flexible engaging concave 44 which engages with a engaging projection 42 of the block body 2.

As shown in FIG. 11, when the lower cover 5 is engaged with the block body 2, the bottom surface 42 (as a substitute use of the reference numeral) is approximately flush with a bottom surface 16*a* of the bracket 16 of the block body 2 (flush with the same plane or situated a little higher than the bottom surface 16*a* of the bracket 16). Thereby, the joint connector block 1 can be mounted on a mount of a vehicle body and so on compactly without interference. Further, the package density upon transportation can be reduced.

Of course the directional characteristic of the joint connector block 1 may be changed into various directions depending on its mounting direction to a vehicle body and so on. Of course the longitudinal busbar 3 and the lateral busbar 4 may be reversed depending on the mounting direction of the joint connector block 1.

In the following, a joint connector block and its assembling method will be explained, by which an engaging member for fixing a plurality of connectors can be mounted with a good workability, a secure connector-fixing force can be obtained, a good reliability of connector-fixing can be obtained, the mounting of the engaging member can be confirmed easily securely by visual observation, and an incomplete insertion of a connector can be securely prevented from occurring.

Figure 12:
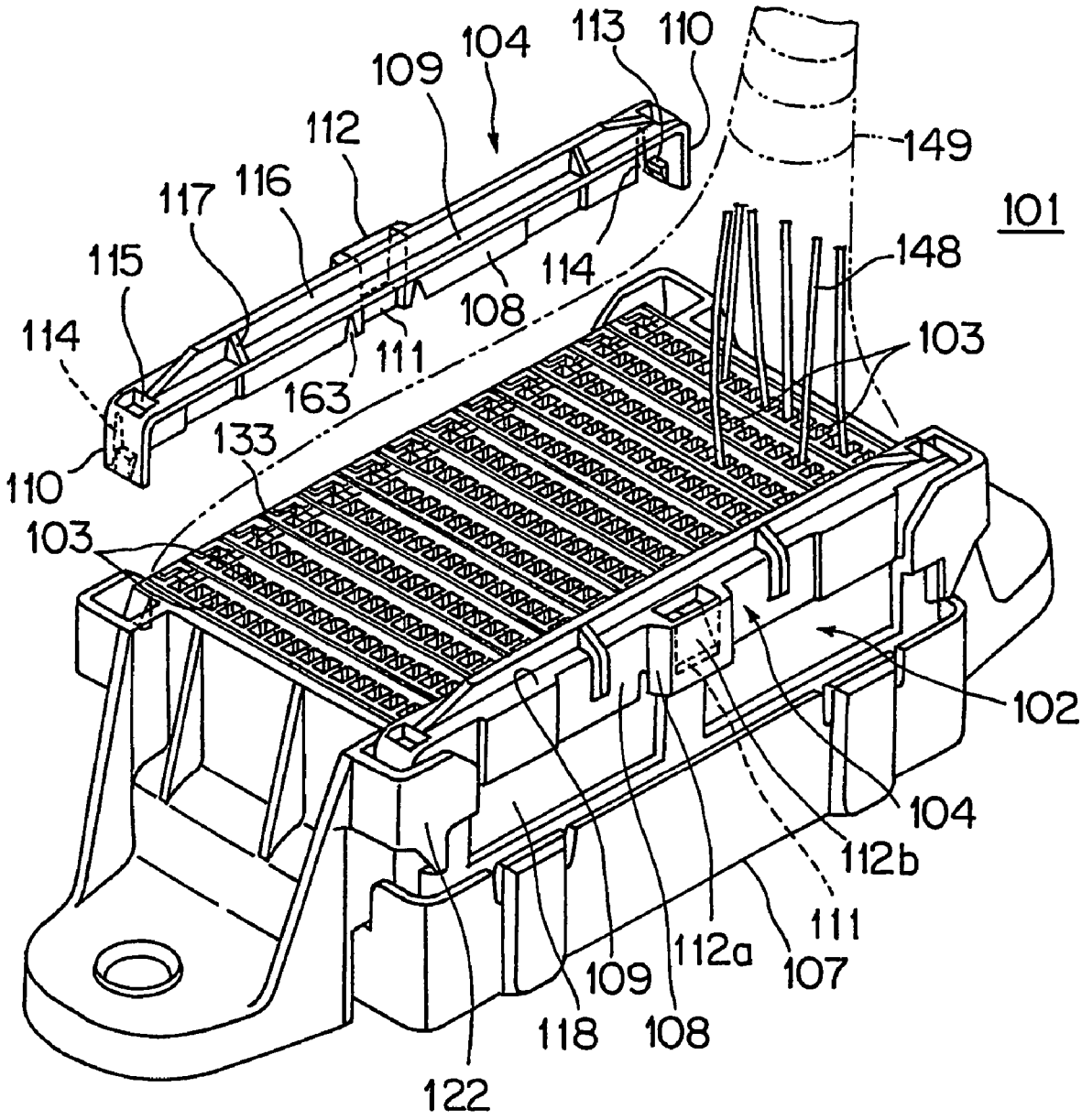
FIG. 12 is an exploded perspective view illustrating a preferred embodiment of a joint connector block according to the present invention.

FIG. 12 shows a preferred embodiment of a joint connector block according to the present invention.

The joint connector block 101 includes: a casing 102 (block body) made of synthetic resin; a plurality of connectors 103 received in the upper half of the casing 102 being arranged in a line; a pair of spacer pins 104 made of synthetic resin as an engaging member for pushing and fixing an upper ends of the respective connectors 103 onto an upper ends of the casing 102 situated on both sides of the casing 102; a plurality of longitudinal and lateral busbars 105, 106 (see FIG. 13) having a terminal, which are received in the lower half of the casing 102; and a lower cover 107 made of synthetic resin, which engages with the bottom of the casing 102.

Each spacer pin 104 is arranged on the upper end of the casing 102 at both sides in the width direction (left and right) and fixed on the casing 102 by the respective engaging members. That is, the spacer pin 104 includes: a plate-shaped vertical wall 108 extending in the longitudinal direction of the spacer pin 104; a horizontal wall 109 on the upper side crossing the wall 108 at right angles; vertical engaging walls 110 continuing to and crossing each wall 108, 109 at the front and rear ends thereof; and convex part 112 including inwardly extending engaging part 111 at the center of the vertical wall 108. The wall 108 functions as a part extending along the wall 118 of the casing 102, while the wall 109 functions as a part abutting against the connector 103. The convex part 112 functions as a protection wall.

The engaging wall 110 includes an inwardly extending engaging projection 113 and has flexibility in the thickness direction with a vertical slit 114 formed between the vertical wall 108 and the engaging wall 110. The reference numeral 115 denotes a hole for the engaging projection 113.

The convex part 112 (protection wall) is formed in a shape with narrow walls 112*a* situated in front and behind and wide wall 112*b* situated at the front side thereof, and includes the engaging part 111 at inner lower end and an opening (the hole) at the upper end. The engaging part 111 has a horizontal engaging face extending upward. The narrow wall 112*a* continues to the vertical wall 108 by way of a slit 163 and is provided with flexibility in the thickness direction with the slit 163 at the convex part 112.

An inner surface of the wall 109 is formed flat and the inner surface abuts against an upper end of each connector 103, thereby preventing the connector 103 from slipping off. A vertical rib 116 stands up from the center in the width direction of an outer surface of the wall 109. The rib 116 is reinforced by a small lateral rib 117, thereby preventing the wall from bending and keeping the flatness of the inner surface of the wall.

Figure 13:
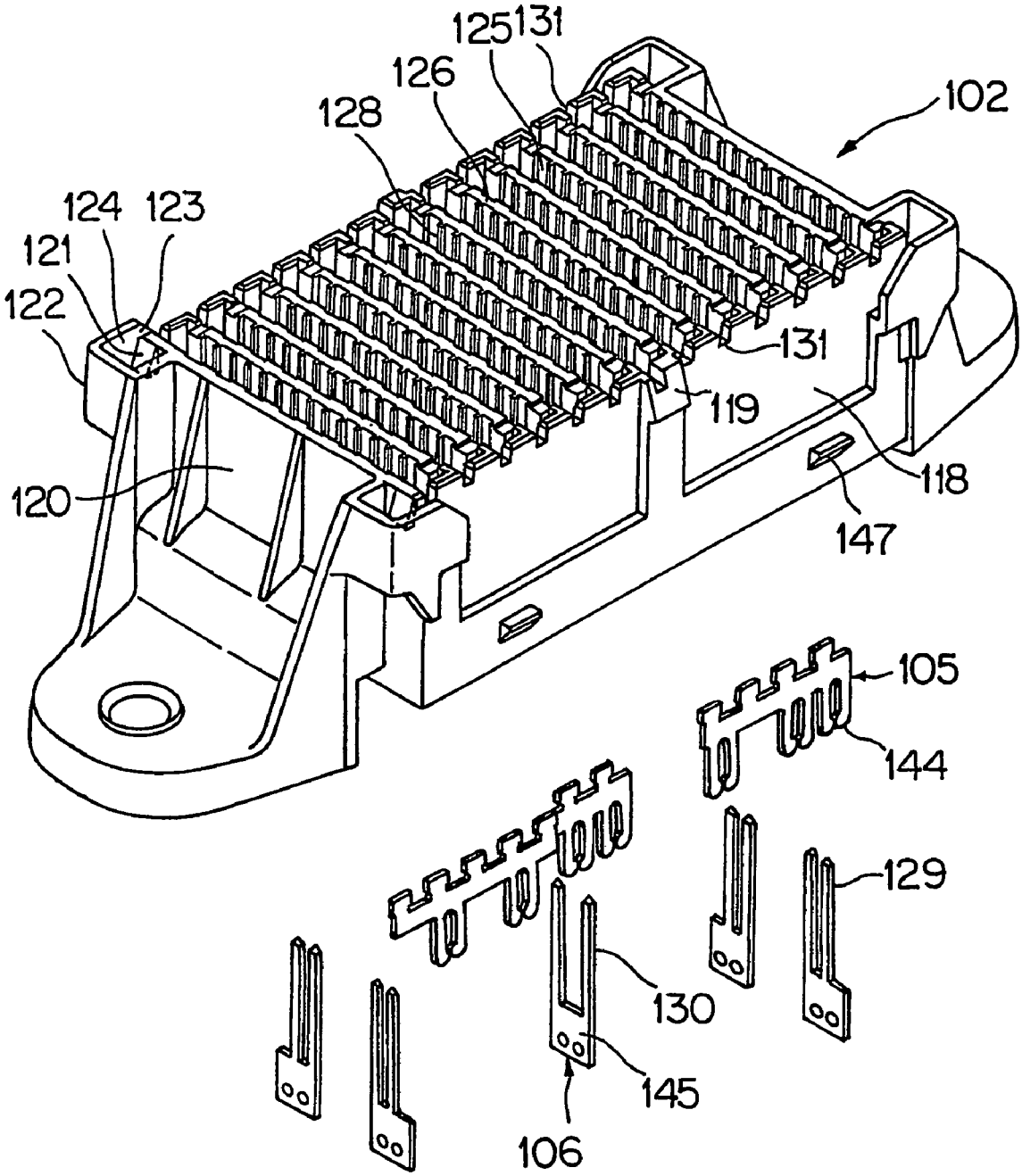
FIG. 13 is an exploded perspective view illustrating a casing and busbars with a terminal, which constitute a joint connector block.

As shown in FIG. 13, the casing 102 is provided with an engaging projection 119 for engaging with the engaging projection 111 of the spacer pin 104 (see FIG. 12) at the center on the outer surface of the walls 118 situated on both sides right and left. The casing is also provided with an engaging projection 121 for engaging with the engaging projection 113 of the engaging wall 110 (i.e. engaging arm) of the spacer pin 104 at both ends situated right and left of walls 120 situated on both sides in front and behind. Each engaging projection 119, 121 has an inclined face extending upward. The outside of the engaging projection 121 situated in front and behind is surrounded by a protection wall 122 that is integral with the casing 112. A gap 123 for receiving the vertical wall 108 of the spacer pin 104 (see FIG. 12) is provided between an outer wall 122*a* of the protection wall 122 and the wall 118. The engaging wall 110 of the spacer pin 104 enters into a rectangular inside space 124 of the protection wall 122.

As shown in FIG. 12, the engaging wall 110 of the spacer pin 104 is surrounded by the protection wall 122 so as to being protected from interference with the outside. An engaging state between the engaging projection 111 and the engaging projection 119 of the casing 102 (see FIG. 13) is protected by being surrounded by the convex part 112 and protected from interference with the outside. Thereby, the engaging state of the spacer pin 104, that is, the fixing state of each connector 103 (see FIG. 12) is secured stably, preventing the spacer pin 104 from slipping off. When the casing 102 is short (for example, half the length of the casing shown in FIG. 12), of course the spacer pin 104 also becomes short, then the engaging means 111, 119 become unnecessary. The spacer pins 104 situated right and left are identical to each other, thereby reducing the cost of a mold for molding.

As shown in FIG. 13, a plurality of connector-fitting chambers 125 are arranged in a line in the upper half of the casing 102. The connector-fitting chambers 125 are partitioned by partition walls 126. The partition wall 126 is provided with a rib 128 corresponding to a partition wall 127 (see FIG. 14) of a connector-fitting chamber of the connector 103. The rib 128 isolates branch terminals 129, 130 of busbars 105, 106 from each other.

Figure 14:
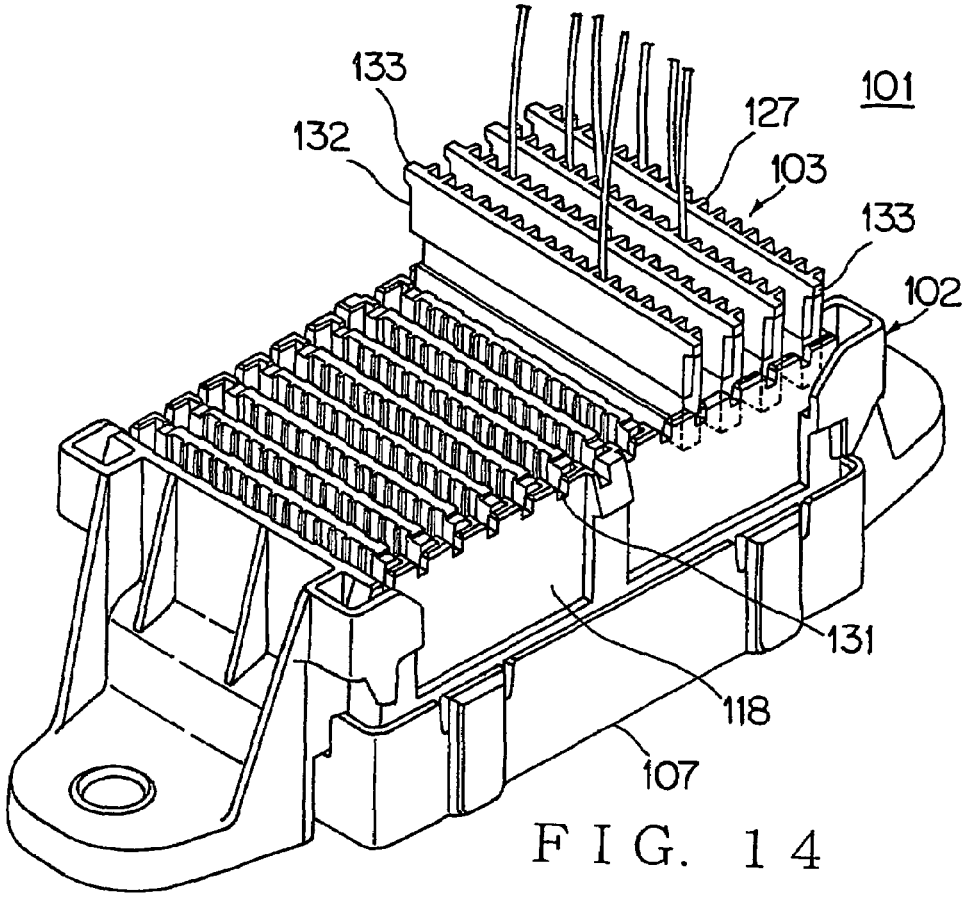
FIG. 14 is a perspective view illustrating a state when connectors are inserted into a casing.

At each end left and right of an opening of each connector-fitting chamber 125, there is provided a small rectangular notch (hollow) 131 on the wall 118 of the casing 102. As shown in FIG. 14, corresponding to each notch 131, there is provided a lateral rectangular horizontal projection 133 at each end left and right of the upper end of a housing 132 made of synthetic resin of the connector 103. The height of the projection 133 is equal to the depth of the notch 131 and the projecting length of the projection 133 is equal to the width of the notch 131, i.e. the thickness of the wall 118.

When the projection 133 abuts against the horizontal wall 109 located on the upper side of the spacer pin 104 (see FIG. 12), the connector 103 is prevented from slipping off. The spacer pin 104 does not abut against any part of the housing except the projection 133. A plurality of the connector-fitting chambers located from the left end to the right end of the connector 103 function effectively without being closed by the spacer pin 103. When the projection 133 enters into the notch 131, the upper end of the casing 102 is flush with the upper end of the connector 103, thereby preventing the connector 103 from projecting upward.

Figure 15:
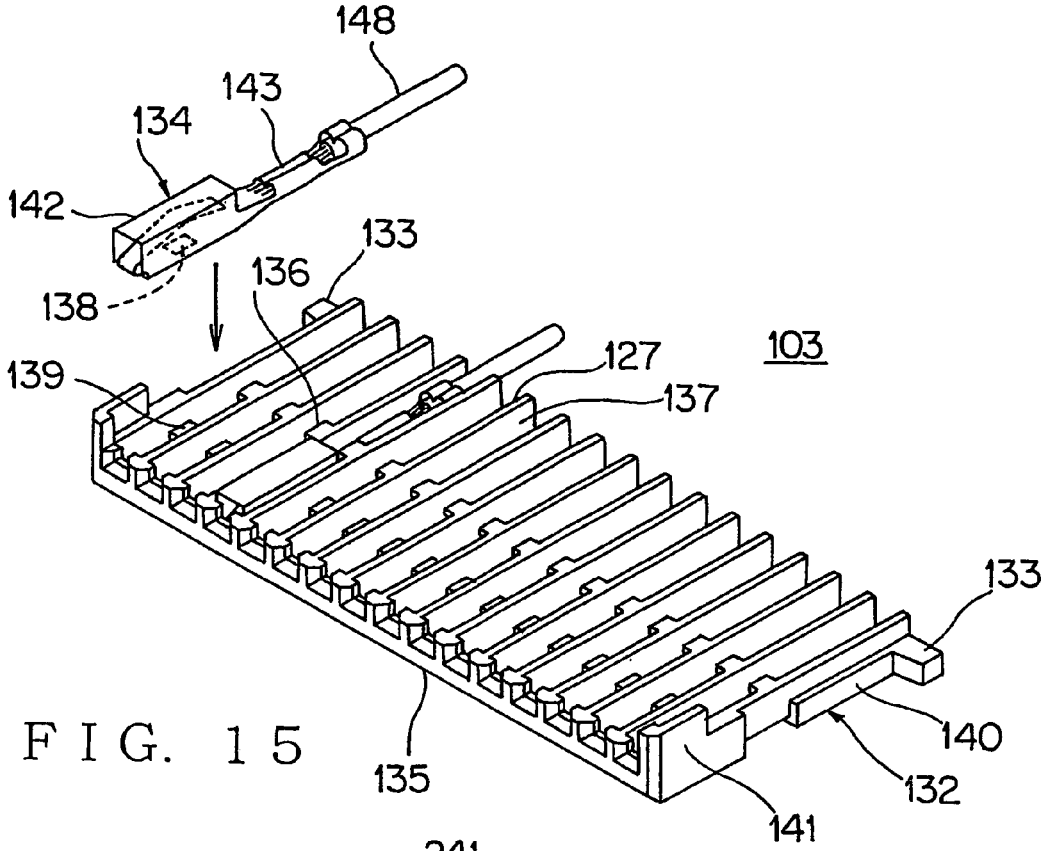
FIG. 15 is an exploded perspective view illustrating a preferred embodiment of a connector.

As shown in FIG. 15, the connector 103 includes the housing 132 made of synthetic resin and small female terminals 134 having an electric wire, which are received in a line in the housing, thereby the connector 103 is formed thin. The housing 132 includes a wide plate-shaped base wall 135 and a plurality of partition walls 127 standing up from the base wall 135 with the same pitch. An opening end of the partition wall 127 is provided with a flexible engaging piece 136 for engaging with the terminal 134. The base wall 135 is provided with a engaging projection 139 for engaging with a hole 138 of the terminal 134 in each terminal-receiving chamber 137 between the partition walls. The terminal 134 is fixed in the thickness direction of the connector 103 by the engaging piece 136 and fixed in the longitudinal direction of the terminal-receiving chamber 137 by the engaging projection 139.

The outwardly extending projection 133 is formed at the upper end of both side walls 140 of the housing 132. The lower end of the side wall 140 is provided with a projecting plate 141, which is a stabilizer for preventing falling down. The connector 103 is not formed as a kit-cut type (i.e. a plurality of the housing being connected in a line so as to be cut) but a type of being molded independently. The terminal 134 includes a female electric contact 142 on one side thereof and a wire-connecting part 143 on the opposite side thereof. There is provided a resilient contact piece for the branch terminals 129, 130 of the busbars 105, 106 (see FIG. 13).

As shown in FIG. 13, the busbars 105, 106 are arranged crossing each other at right angles extending longitudinally and laterally, respectively, connecting to each other by a pair of clip terminals 144 and a connecting part 145, respectively. Each busbar 105, 106 includes a pin-shaped branch terminal 129, 130 situated on the reverse side of the pair of the clip terminals 144 and the connecting part 145. The casing 102 includes slits and grooves (not shown) arranged with the same pitch for receiving the longitudinal busbar 105 and each branch terminal 129, 130 in the lower half of the casing. The lower cover 107 (see FIG. 12) is mounted on the casing 102 when each busbar 105, 106 is received in the casing 102, and the lower cover 107 is fixed by an engaging projection 147 (see FIG. 13).

As shown in FIG. 14, the connector 103 is inserted into the casing 102 and each branch terminal 129, 130 is inserted into the corresponding female terminal 134 (see FIG. 15) so that each connector 103 is joint-connected to each other through the busbar 105, 106. Each electric wire 148 (see FIG. 12) guided out from the connector constitutes a wiring harness 149.

The connector 103 is inserted in the casing one by one, and after its height is checked, the spacer pin 104 is mounted. The connector may be inserted into the casing one by one by using a jig, which is connected to an actuator such as an air cylinder, in an automatic assembly step.

In such a case, a sensor (not shown) may detect the stroke of the cylinder every time the connector 103 is inserted, or alternatively, a sensor may detect the position of the upper end of the housing of the connector 103, thereby the insertion height of the connector 103 can be controlled.

Although FIG. 14 illustrates a state when a plurality of the connectors 103 are halfway inserted for convenience, actually as described above, preferably, each connector 103 is completely inserted one by one. As shown in FIG. 14, a plurality of the connectors 103 may be simultaneously inserted with the jig so as to control the height. Such constructions are effective as a method of assembling a joint connector block.

In the event that the connector 103 is incompletely inserted without carrying out the height control, since the spacer pin 104 interferes with the highly projecting incompletely inserted connector 103 causing that the spacer pin 104 cannot be mounted on the casing 102, therefore a worker can detect the abnormality easily. In the event that the connector 103 is incompletely inserted, by pushing strongly downward the spacer pins 104 situated left and right simultaneously, the incompletely inserted connector 103 can be inserted completely, thereby securely preventing the abnormality from occurring.

Figure 16:
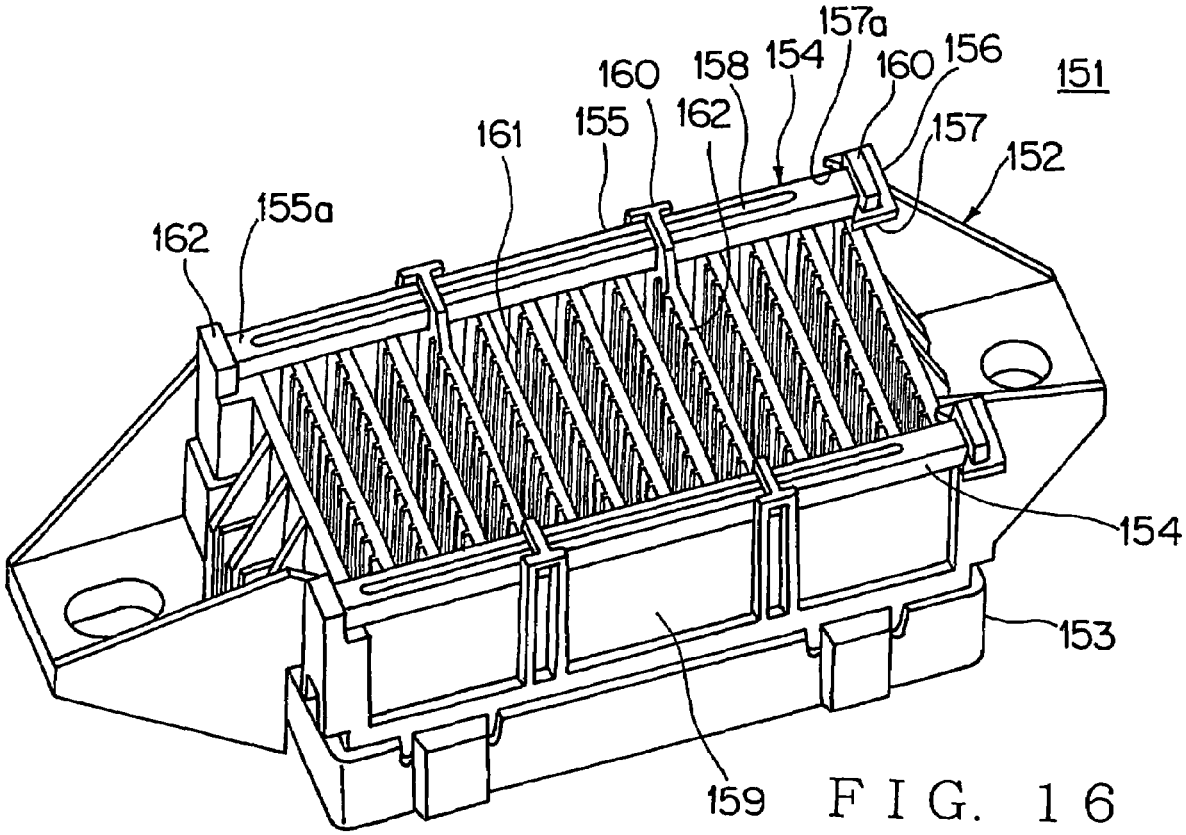
FIG. 16 is a perspective view illustrating another preferred embodiment of a joint connector block.

FIG. 16 is a perspective view illustrating another preferred embodiment of a joint connector block according to the present invention.

The joint connector block 151 includes: a casing 152 made of synthetic resin; a lower cover 153; a plurality of connectors (not shown) to be received in a line in the upper half of the casing 152; and a pair of spacer pins 154 to be slidably mounted in the longitudinal direction of the casing 152 at the upper end on both sides left and right of the casing 152.

The spacer pin 154 includes a rectangular pole-shaped body 155 and a pair of flexible short locking arm 157, which is provided protrudingly from a wide base end 156 of the body 155 in parallel with the body 155. The top and bottom surfaces of the body 155 are provided with the respective grooves extending in the longitudinal direction thereof so as to prevent the bend from occurring. Each locking arm 157 is provided with an inwardly extending locking projection 157*a* at an end thereof.

The casing 152 is integrally provided with frame-shaped guides 160 for receiving the spacer pin at the upper end of walls 159 situated left and right. The middle guide 160 integrally continues to the upper end of a partition wall 162 of a connector-fitting chamber 161. The locking projection 157*a* engages with the guide 160. The spacer pin 154 is inserted when all of the connectors are inserted in the casing 152. The end of the spacer pin 154 abuts against the partition wall 162 and is halted.

The housing of the connector may includes a projection (see FIG. 14), which is abutted by the spacer pin, at the upper end thereof. Alternatively, the spacer pin 154 may directly abut against the upper end of the housing (preferably, the upper end face of the wall on the short side of the housing), which is cut into a required length being separated from a chain-shaped housing member. In this case, the spacer pin 154 can abut against the housing with a wide area, thereby securely preventing the connector from slipping out and simplifying a mold for molding the housing.

The spacer pins 154 are identical left and right, and can be commonly used. Preferably, the insertion height may be controlled as described above and thereafter the spacer pin 154 may be inserted. In the event that an incomplete insertion of the connector takes place, an end 155*a* of the spacer pin 154 abuts against the incompletely inserted connector, thereby detecting the abnormality.

In each preferred embodiment as described above, the electric wire 148 may be connected to the terminal of the connector 103 not by crimping but by pressure-welding. If the thickness of the wall 118 of the casing 102 is large, the notch 131 may be a concave groove which does not penetrate through the wall 118. Normally, a pair of the spacer pins 104, 154 is used, however instead, if the width of the connector 103 is small, only one spacer pin 104, 154 may be arranged on one side of the connector 103. The projection 133 of the connector 103 may have not a rectangular shape but a cylindrical shape. The shapes of the projection 133 and the notch 131 of the casing 102 may have a shape for matching (for example, when the projection 133 having a cylindrical shape, the notch having a half-circle shape) besides the rectangular shape. Each direction of front and behind, left and right or upper and lower is defined depending on the mounting direction of the joint connector block onto a vehicle body or the like, therefore each direction of front and behind, left and right or upper and lower may be reversed depending on the mounting direction.

In the following, an electric junction box will be explained, by which connectors can be smoothly coupled with each other, an undesirable interference between terminals can be prevented from occurring, and reliability of the terminal connection can be maintained and improved.

Figure 17:
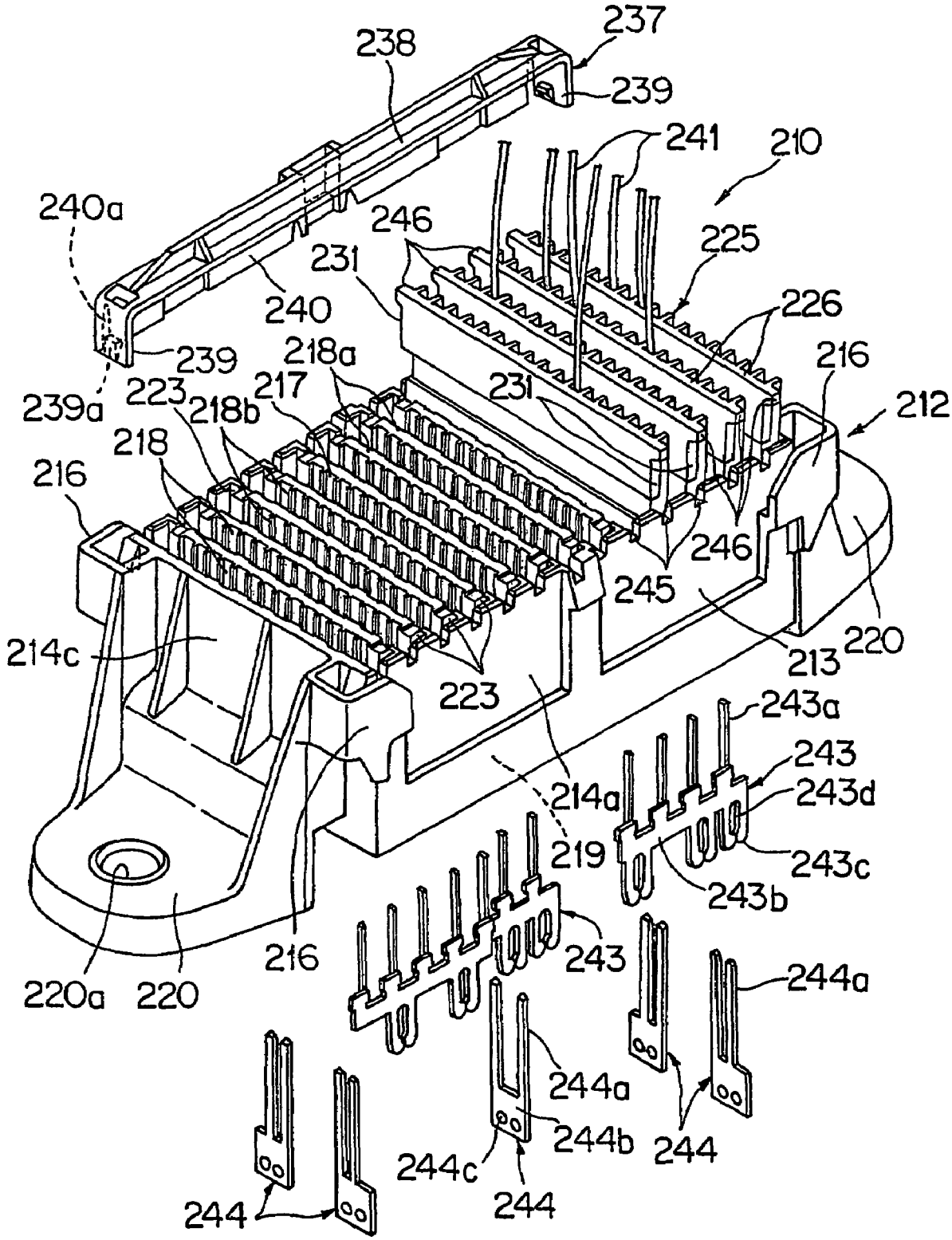
FIG. 17 is an exploded perspective view illustrating a preferred embodiment of an electric junction box according to the present invention.

FIG. 17 shows a preferred embodiment of an electric junction box according to the present invention.

A joint box (electric junction box) to be mounted on a vehicle such as a motor vehicle is an electrically connecting component, in which an outer circuit is connected to a circuit structure of busbars and so on for constituting a joint circuit through a wiring harness so as to make an electric signal diverge to plural signals.

The joint box 210 (electric junction box) includes a joint connector block 212 and joint connectors 225. The joint connector block 212 includes a casing 213 made of insulating resin, a plurality of longitudinal busbars 243 and a plurality of lateral busbars 244, both of which are inserted into the casing 213 from the bottom, and a cover (not shown) made of insulating resin for preventing each busbar 243, 244 from coming off. Each joint connector 225, which is connected to electric wires 241, is inserted into the casing 213 from the top. Each female terminal 233, which is received in a housing 226, is connected to a corresponding tab terminal 243*a*, 244*a* of the busbar 243, 244, respectively.

The joint box 210 of the present invention positions the joint connector 225, which is received into a corresponding connector-fitting chamber 218, and prevents an undesirable interference between the tab terminal 243*a*, 244*a* and the female terminal 233 from occurring, thereby improving the reliability of terminal connection. The joint box 210 includes: the casing 213 which has connector-fitting part 217 that has a plurality of connector-fitting chambers 218 on the upper side and a busbar-receiving part 219 for receiving the busbars 243, 244 on the lower side; the housing 226 for receiving the female terminals 233; and the joint connectors 225, each of which fits into the corresponding connector-fitting part 217. Each guide groove 223 is formed in both side walls 214*a* which constitutes a connector-fitting chamber 218. Each guide rib 224 (see FIGS. 19 and 20) for engaging with the corresponding guide groove 223 is formed on both side walls 231 on the insertion end of the housing 226.

Instead, the guide rib may be formed on both side walls 214*a* of the connector-fitting chamber 218 and the guide groove may be formed in both side walls 231 of the housing 226.

Since the guide rib 224 is formed is formed on both side walls 231 on the insertion end of the housing 226, the electric contact 234-side of the female terminal 233, which is mounted in the joint connector 225, is bound, thereby effectively preventing the positional displacement in a direction crossing the insertion direction of the joint connector 225 at right angles from occurring.

In the following a primary constitutional part and its functional action of the joint box 210 will be explained in detail.

The casing 213 includes: the connector-fitting part 217 in its upper half; the busbar-receiving part 219 to be covered with the cover (not shown) in its lower half; and a pair of brackets 220 to be fixed on a panel (not shown) of a vehicle body or the like in the front and rear direction.

The connector-fitting part 217 includes a plurality of the slot-shaped connector-fitting chambers 218 arranged in a line, each chamber 218 being divided by vertical partition walls 218*a* with the same pitch in a frame surrounded the walls situated front and rear, and left and right. A plurality of the ribs 218*b* are formed on the partition wall 218*a* and the rear wall 214*b* with the same pitch and a space for receiving a terminal is formed between the respective ribs 218. The projection length of the rib 218 is small and each partition wall 229 of the housing 226 of the joint connector 225 is positioned facing the corresponding rib 218*b*.

Each connector-fitting chamber 218 is formed open on its upper part. Its each narrow wall situated left and right is the corresponding side wall 214*a* situated left and right facing each other of the casing 213. Each wide wall situated in front and rear is the partition wall 218*a*, front wall 214*c* or rear wall 214*b*.

Figure 18:
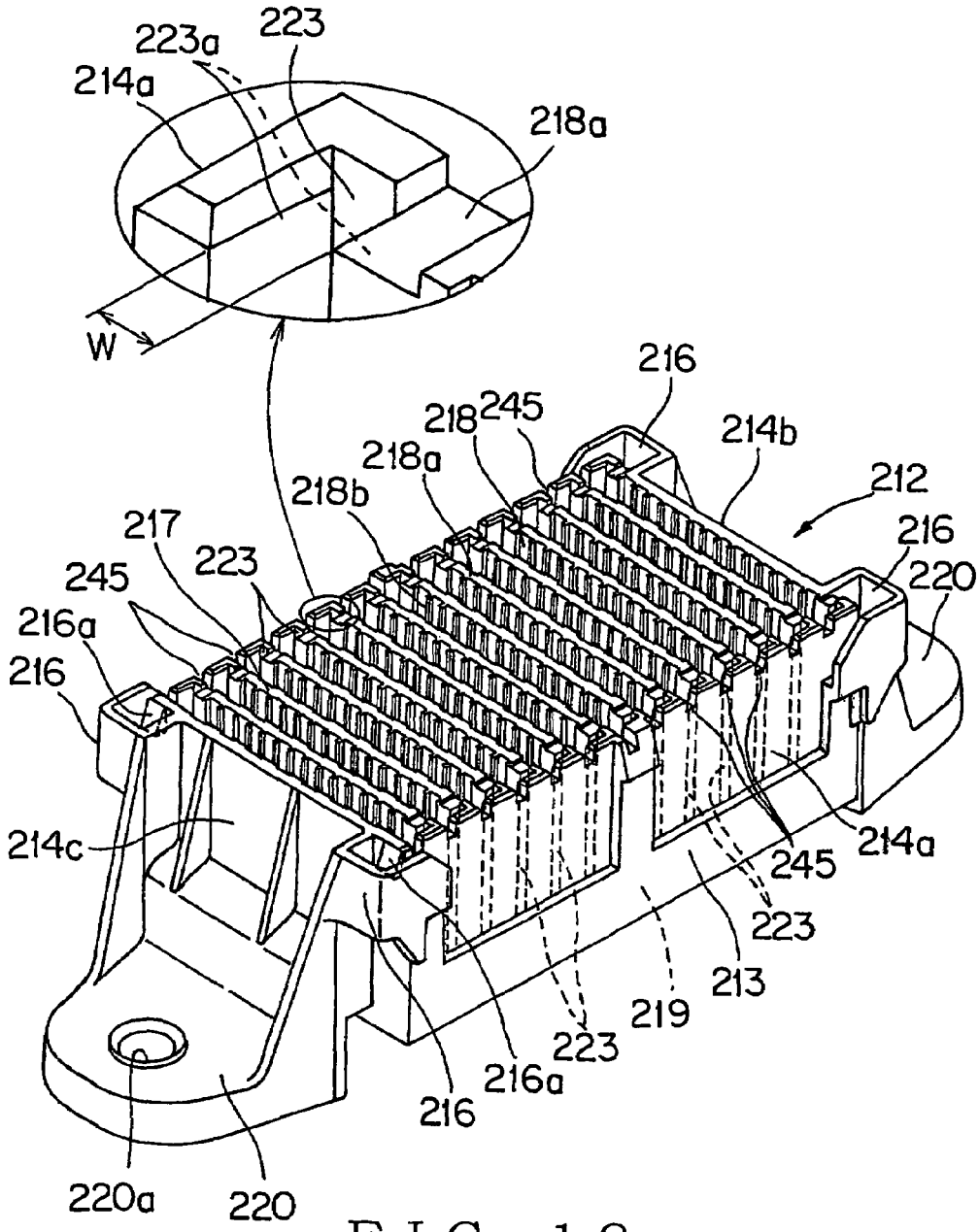
FIG. 18 is a perspective view of the joint connector block shown in FIG. 17.

The guide groove 223 is formed in the side wall 214*a* situated left and right of the connector-fitting chamber 218. The guide groove 223 is formed communicating with the bottom part from an end of the opening of the connector-fitting chamber 218 (see FIG. 18). Therefore, the joint connector 225 is slidably guided thoroughly, thereby improving the workability of fitting of the joint connector 225.

Figure 19:
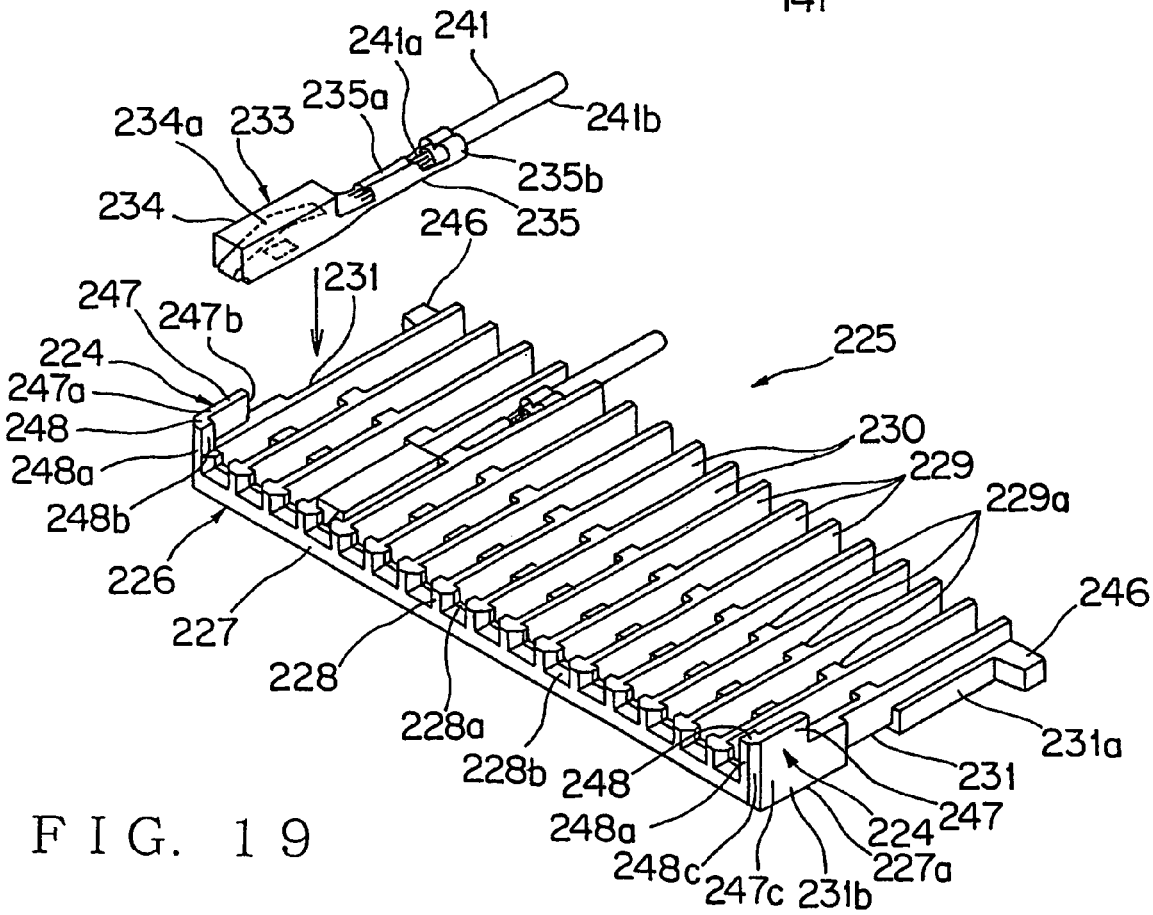
FIG. 19 is an exploded perspective view of the joint connector shown in FIG. 17.
Figure 20:
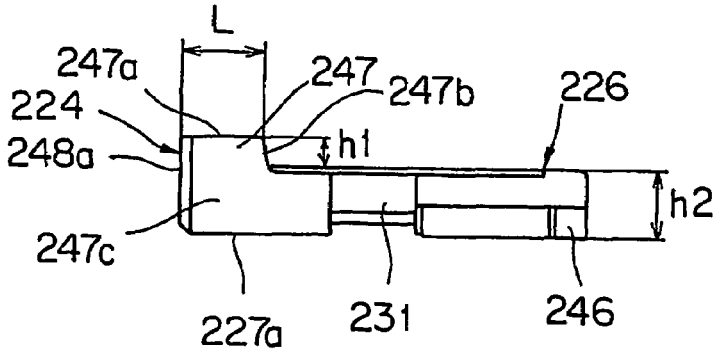
FIG. 20 is a side view of the joint connector shown in FIG. 19.

The guide rib 224 is formed projecting in the standing-up direction of the partition wall 229 on both side walls 231 of the joint connector 225 (housing 226) corresponding to the guide groove 223 (see FIGS. 19 and 20). The guide rib 224 engages with the guide groove 223, thereby preventing an undesirable interference between the terminals from occurring and improving the reliability of the terminal connection.

A rectangular concave part 245 is formed at the end of the opening of the side walls 214*a* situated left and right of the connector-fitting chamber 218. A projection 246 is formed projecting in a lateral direction (left and right direction) on both side walls 231 of the joint connector 225 (housing 226) corresponding to the concave part 245 (see FIGS. 19 and 20).

The projection 246 is formed on the end of the opening from which the electric wires 241 are guided out from the joint connector 225. An end face of the projection 246 is formed flush with an end face of the housing 226. Thereby, the back face (flat face) of a connection part of the engaging spacer 237 is put to the end faces of the projection 246 and housing 226, thereby stabilizing the fixed position of the engaging spacer 237 and securely engaging the joint connector 225 without looseness.

The cover (not shown) prevents the busbars 243, 244 from coming off by being put to the busbar-receiving part 219 from the bottom after the busbars 243, 244 are mounted in the busbar-receiving part 219. A locking projection (not shown) is formed on both side walls 214*a* of the casing 213 and a locking part (not shown) is formed on an inner face of the cover, thereby the locking projection engages with the locking part so as to mount the cover when the cover is applied onto the casing 213.

The busbar-receiving part 219 is formed inside the casing and constituted by longitudinal grooves (not shown) partitioned by a plurality of partition walls (not shown) extending in the front and rear direction and lateral grooves (not shown), each of which communicates notches formed on the partitioned walls with each other in a direction crossing the longitudinal groove at right angles.

Each busbar 243, 244 is formed by stamping an electrically conductive plate and being bent according to needs. The longitudinal busbar 243 includes a band part 243*b*, a plurality of pairs of clip terminals 243*c* formed on one side of the band part 243*b*, and tab terminals 243*a* formed on the opposite side of the band part 243*b*. Each pair of the clip terminals 243*c* has a slit 243*d* between both terminals. The slit 243*d* clips a band part 244*b* of the lateral busbar 244 so as to construct the joint circuit.

The lateral busbar 244 includes a band part 244*b* and at least one tab terminal 244*a* formed on one side of the band part 244*b*. The tab terminal 244*a* penetrates through a terminal insertion hole formed in the bottom part (not shown) of the busbar-receiving part 235, projects into the connector-fitting chamber 218, and is connected to the female terminal 233 of the joint connector 225.

A frame 216 for receiving an arm 239 of the engaging spacer 237 is formed outside the connector-fitting part 217 at a corner of an outer wall of the joint connector block 212. The arm 239 is inserted into a cylinder of the frame 216, thereby the arm 239 is protected by the frame 216, preventing the arm 239 from abruptly coming out by an interference with the outside.

The long engaging spacer 237 made of insulating resin includes a connection part 238 extending straightly in the horizontal direction, a pair of arms 239 continuing to both ends of the connection part 238 crossing at right angles, and a vertical depending wall 240 continuing to one side of the connection part 238 crossing at right angles. A slit 240*a* is formed at a crossing line between the arm 239 and the vertical depending wall 240, allowing the arm to be bent. The back face of the connection part 238 is formed flat so as to be put to the end of a plurality of the joint connectors.

A locking claw 239*a* projecting inward is formed on an inner face on the end side of the arm 239. When the engaging spacer 239 faces the side wall 214*a* of the casing 213 and is applied onto the upper end of the side wall 214*a*, the arm 239 is inserted into the cylinder of the frame 216 and the locking claw 239*a* engages with the projection 216*a* in the cylinder, thereby engaging the engaging spacer 237. Thereby, the connection part 238 is put to a plurality of the ends of the joint connectors 225 and a plurality of the joint connectors 225 is collectively engaged, thereby securely fixing the joint connectors 225.

As shown in FIGS. 19 and 20, the joint connector 225 includes female terminals 233 to be connected to the tab terminals 243*a*, 244*a* of the busbars 243, 244 (see FIG. 17) and the plate-shaped housing 226. The joint connector 225 and the electric wires 241 to be connected to the female terminals 233 constitute a wiring harness.

The housing 226 made of insulating resin includes a flat board 227, partition walls 229 and front walls 228 standing up crossing at right angles from the board 227, and side walls 231 at both sides. A projection 229*a* for preventing the female terminal 233 from coming out is formed at the middle of the partition wall 229. The projection length of the projection 229*a* is formed so as not to obstruct the insertion of the female terminal 233 which is inserted from the top.

A thin and long terminal-receiving part 230 is formed between the adjacent partition walls 229 of the housing 226 so as to receive the female terminal 233 form a direction indicated by an arrow in FIG. 19. The electric contact 234 of the received terminal 233 abuts against the front wall 228 of the housing 226 so as not to come off in the forward direction, while the electric contact 234 abuts against the projection 229*a* so as not to come off in the upward and backward directions. That is, the female terminal 233 received in the terminal-receiving part 230 does not come off from the terminal-receiving part 230.

Insertion holes 228*a* for inserting the tab terminals 243*a*, 244*a* of the longitudinal and lateral busbars 243, 244 are formed in the front walls 228 of the housing 226. The inlet of the hole 228*a* is formed on a tapered surface 228*b*, thereby each tab terminal 243*a*, 244*a* is guided by the tapered surface 228*a* so as to be inserted into the electric contact 234, and clipped by a resilient force of a resilient contact piece 234*a*.

The side wall 231 is formed parallel to the partition wall 229. The terminal-receiving part 230 is also formed between the side wall 231 and the partition wall 229. Outside the side wall 231, there are formed a thick part 231*b* extending toward the front wall 228 along the side wall 231 and thick part 231*a* extending toward the opposite side (electric wire-guiding-out side) along the side wall 231. The side wall 231 is reinforced by these thick parts 231*a*, 231*b*, thereby preventing the side wall 231 from falling down.

A projection 246 for engaging with a concave part 245 formed in the side walls 214*a* situated left and right of the connector-fitting chamber 218 is formed on the rear end side of the one thick part 231*a*. With the mutual action between the projections 245 and 246, the rear end side of the joint connector 225 is positioned.

A guide rib 224 formed in L-shape in its cross section is formed on the end side of the opposite thick part 231*b*. The guide rib 224 includes a side end 247 and front end 248. The side end 247 projects toward the standing-up direction of the side wall 231, extending along the side wall 231. The front end 248 is a thick part and continues to the end side of the side end 247 crossing at right angles.

The projecting length h1 (see FIG. 20) of the side end 247 is formed to be approximately half of the height h2 of the partition wall 229 or the side wall 231, which partitions the terminal-receiving part 230, thereby preventing the side end 247 from being deformed and securing the positioning of the joint connector 225.

The length of the side end 247 is formed half of the length of the electric contact 234 of the female terminal 233, thereby restricting the guide rib 224 with the guide groove 223 and preventing the looseness of the joint connector 225 from occurring.

The rear end face 247*b* of the side end 247 is slightly inclined relatively to the side wall 231, thereby preventing an undesirable interference from occurring when the joint connector 225 is taken out from the connector-fitting chamber 218.

The front end 248 is formed thick and the thick part is protruded inwardly. Since the thickness of the front end 248 is formed approximately the same as the width W (see FIG. 18) of the guide groove 223, the inner end face 248*b* and the side end face 247*c* abut against wall faces 223*a* in the groove situated at both sides of the guide groove 223 so that the joint connector 225 is positioned in the left and right direction.

The front end face 248*a* of the front end 248 is formed flush with the front wall 228. The crossing line between the front end face 248*a* and the side end face 247*c* is formed as a tapered surface 248*c*, thereby improving the insertion property of the joint connector 225.

The upper end face of the front end 248 is formed flush with the upper end face 247*a* of the side end 247. The upper end face 247*a* is parallel to the lower face 227*a* of the board 227. The upper face and the lower face 227*a* abut against the respective walls of the connector-fitting chamber 218, thereby positioning of the joint connector 225 in its up and down direction (i.e. a direction crossing the insertion direction of the connector at right angles).

With the construction of the guide rib 224 as described above, the positioning of the joint connector 225 is carried out for the two directions (left and right direction, and up and down direction) which cross the front and rear direction at right angles, thereby restricting the electric contact 234-side of the female terminal 233, which is mounted in the joint connector 225, preventing an undesirable interference between the terminals from occurring, and improving the reliability of the terminal connection.

The female terminal 233 is the same as a normal female terminal and is formed by stamping an electrically conductive plate and by bending. The female terminal 233 is provided with a box-shaped electric contact 234 on one side thereof and an electric wire-connecting part 235 on the opposite side thereof. Inside the electric contact 234, a resilient contact piece 234*a* is formed being bent and clips the tab terminal 243*a*, 244*a* of the busbars 243, 244. The electric wire-connecting part 235 includes a pair of crimp-contact pieces 235*a*, 235*b* situated in front and rear, to which a core 241*a* and insulating coating 241*b* of the electric wire 241 are crimp-contacted. The electric wire-connecting part 235 may be a pair of pressure-welding pieces.

In the following, a joint box (i.e. an electric junction box) will be explained, by which a joint connector never slips off from a connector-fitting part of a joint connector block, the joint connector can be securely mounted, and a good workability of the mounting can be attained.

Figure 21:
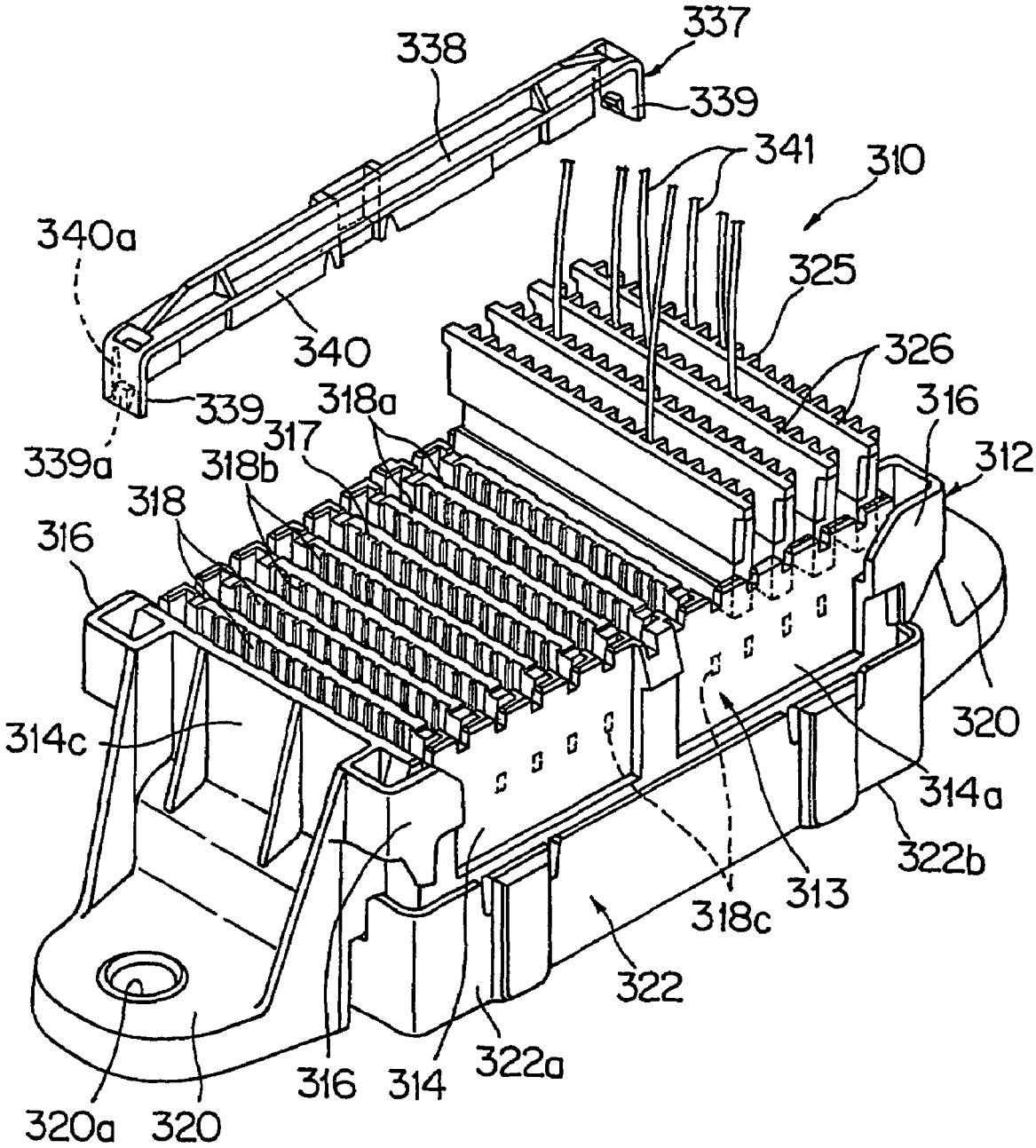
FIG. 21 is a perspective view illustrating a preferred embodiment of an electric junction box according to the present invention.

FIG. 21 illustrates a preferred embodiment of an electric junction box according to the present invention.

The joint box 310 (electric junction box) includes a joint connector block 312 and joint connectors 325. The joint connector block 312 includes a casing 313 made of insulating resin, a plurality of busbars 323 having at least one terminal, which busbar are inserted into the casing 313 from the bottom, and a cover 322 made of insulating resin for preventing each busbar 323 from coming off. Each joint connector 325, which is connected to electric wires 341, is inserted into the casing 313 from the top. The joint connector 325, to which the electric wires 341 is connected, is inserted from the top of the casing 313. A female terminal 333 is connected to a tab terminal 323*a* of the busbar 323.

The joint box 310 according to the present invention includes: a casing 313, which includes a connector-fitting part 317 having a plurality of connector-fitting chambers 318 on the upper side and a busbar-receiving part 319 for receiving busbars 323 with a terminal on the lower side; a housing 326 for receiving female terminals 333 to be connected to a tab terminal 323*a* of the busbar 323; and joint connectors 325, 325' (the joint connector 325' being shown in FIG. 23) which fit into the connector-fitting part 317, wherein each projection (provisionally engaging part) 318*c* is formed on an inner surface of a corresponding side wall 314*a* that constitutes the connector-fitting chambers 318, and a concave part for engaging with the projection 318*c* is formed on an outer surface of the corresponding side wall 331 of the housing 326. After a plurality of the joint connectors 325, 325' is provisionally engaged, the joint connectors 325, 325' is completely engaged by an engaging spacer (completely engaging member) 337, which includes a connection part 338 and a pair of arms 339 that continues to both ends of the connecting part 338. The horizontal connecting part 338 is put to the ends of the joint connectors 325, while the pair of the arms 339 that continues to the connecting part 338 crossing it at right angles is engaged with an outer wall 314 of the casing 313.

With the construction described above, even when the electric wire 341 connected to the female terminal 333 is abruptly pulled during assembly of the joint connectors 325, 325' into the connector-fitting chamber 318, the joint connectors 325, 325' are prevented from coming off from the connector-fitting chamber 318, thereby enabling one-by-one assembling of a plurality of the joint connectors 325, 325' without an interruption. After all of the joint connectors 325, 325' are assembled, the joint connectors 325, 325' are completely engaged with the engaging spacer 337, thereby the joint connectors 325, 325' are securely fixed and the reliability of the joint-connection can be maintained.

A concave part instead of the projection 318*c* may be formed on the inner surface of both side walls 314*a* of the connector-fitting chamber 318, while a projection instead of the concave part 331*a* may be formed on the outer surface of both side walls 331 of the housing 326. However, according to the preferred embodiment, in which the projection 318*c* is formed on the inner surface of both side walls 314*a* of the connector-fitting chamber 318, and the concave part 331*a* is formed on the outer surface of both side walls 331 of the housing 326, the moldability of both side walls 314*a*, which are thin walls for partitioning the connector-fitting chamber 318, can be improved.

In the following, a primary constitutional part and its functional action of the joint box 10 will be explained in detail.

The casing 313, which constitutes a joint connector block 312, includes a connector-fitting part 317 in its upper half and a busbar-receiving part 319 in its lower half. The connector-fitting part 317 includes a plurality of slot-shaped connector-fitting chambers 318 arranged in a line. Each connector-fitting chamber 318 is formed being partitioned by vertical partition walls 318*a* with the same pitch in a frame surrounded by the walls situated in front and behind, and left and right. The partition wall 318*a* and a rear wall 314*c* are provided with a plurality of ribs 318*b* with the same pitch. A space for receiving a terminal is formed between the ribs 318*b*. The projection length of each rib 318*b* is small. Each partition wall 329 of the housing 326 of the joint connector 325, 325' is positioned corresponding to the corresponding rib 318*b*.

Each connector-fitting chamber 318 has an opening at the upper thereof. Narrow walls situated left and right are side walls 314*a* situated left and right facing each other of the casing 313. Wide walls situated in front and rear are a partition wall 318*a*, front wall 314*b* or rear wall 314*c*. An inner face of the side walls 314*a* situated left and right is provided with a projection 318*c* for engaging with a concave part 331*a* of the joint connector 325, 325'. The projection 318*c* has a triangular shape in a cross section cut along the insertion direction of the joint connector 325, 325' and is positioned at the middle of the up and down direction of the connector-fitting chamber 318.

The projection 318*c* has an inclined surface (not shown) and an engaging surface (not shown). The inclined surface is formed gradually projecting as advancing into the deep of the connector-fitting chamber 318, while the engaging surface is formed crossing the inner face at right angles. When the joint connector 325, 325' is inserted into the connector-fitting chamber 318, the side walls 331 situated left and right climb up the inclined surface so as to advance into the deep, then the side walls 331 situated left and right climb over the inclined surface and then, the concave part 331*a* engages with the projection 318*c*, thereby fixing the joint connector 325, 325' and preventing the joint connector 325, 325' from abruptly coming off from the connector-fitting chamber 318.

The projecting length of the projection 318*c* is adjusted so that the fitting resistance does not become very large, thereby improving the mounting property and maintenance of the joint connector 325, 325'. That is, the projecting length is adjusted so that the joint connector 325, 325' does not come off due to an abrupt pull by a wiring harness.

The joint connector 325, 325' is a multi-polar outside connector for receiving the female terminals 333 of sixteen poles. After the joint connectors 325, 325' are mounted, each joint connector 325, 325' does not come off due to the friction resistance between the terminals 323*a*, 333. However, upon the mounting of the joint connector 325, 325', if a pull force to be applied to the electric wire 341 is larger than the friction resistance between the terminals 323*a*, 333, the joint connectors 325, 325' might come off. According to the present invention, in this respect, each joint connector 325, 325' is securely prevented from coming off by an engaging force with the provisional engaging means in addition to the friction resistance between the terminals 323*a*, 333.

With the provisional engaging means as described above, each joint connector 325, 325' is prevented from being incompletely fit or halfway fit, thereby improving the workability of mounting of each joint connector 325, 325' and the reliability of the mounting.

In the preferred embodiment described above, the projection 318*c* is formed on the side walls 314*a* situated both sides. Instead, the projection 318*c* may be formed on the one side wall 314*a*, the partition wall 318*a*, the front wall 314*b* or the rear wall 314*c*. If the projection 318*c* is formed on both side walls 314*a*, the position stability of the joint connector 325, 325' improves.

Both ends in front and rear of the casing 313 is integrally provided with a bracket 320 having a hole for fixing. A bolt (not shown) passes through the hole 320*a*, thereby the bracket 320 is fixed on a panel (not shown) of a vehicle body.

A frame 316 for receiving an arm 339 of the engaging spacer 337 is formed at a corner of an outer wall 314 and outside the connector-fitting part 317 of the joint connector block 312.

The frame 316 has a rectangular cylindrical shape. In the cylinder, there is formed a projection 316*a* for engaging with an engaging claw 339*a* that is formed on the end side of the arm 339. The projection 316*a* has a triangle shape in its cross section including an inclined surface and engaging surface situated in front and rear in the insertion direction of the arm 339. The inclined surface is a slide surface. The arm 339 is inserted into the cylinder with a weak insertion force, thereafter the engaging claw 339*a* engages with the engaging surface of the projection 316, thereby the arm 319 is fixed.

As described above, the arm 339 of the spacer 337 is inserted into the cylinder of the frame 316, thereby the arm 339 is protected by the frame 316 and preventing the arm 339 from abruptly coming off due to an external interference.

Figure 22:
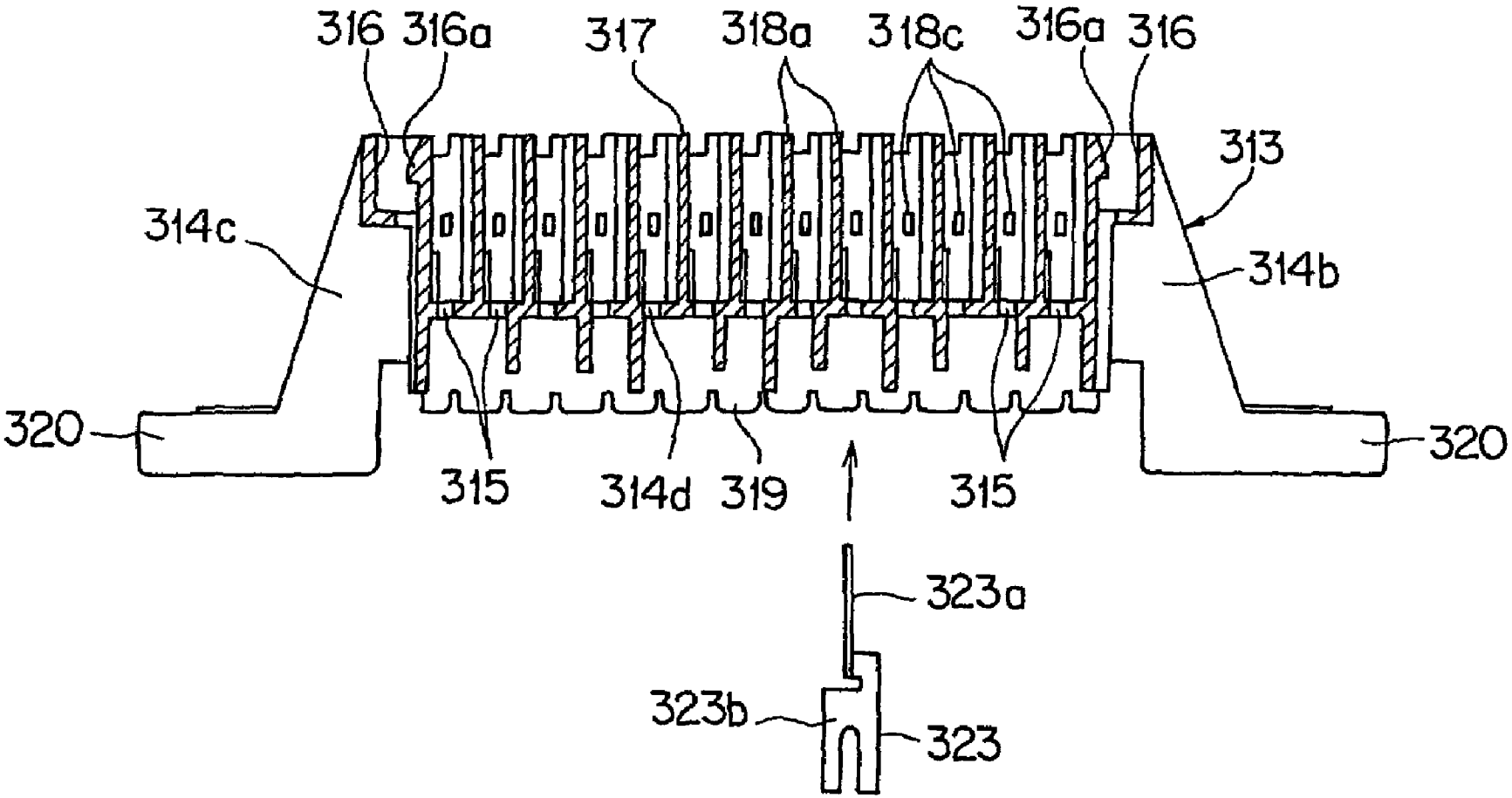
FIG. 22 is a longitudinal sectional view of the joint connector block shown in FIG. 21.

With a bottom wall 314*d* shown in FIG. 22, the busbar-receiving part 319 situated on the lower side is communicated to the connector-fitting part 317 through the tab-insertion hole 315. The tab terminal 323*a* of the busbar 323 with at least one terminal penetrates through the tab-insertion hole 315 and projects into the connector-fitting chamber 318. The projecting length of the tab terminal 323*a* is formed a little smaller than the length of an electric contact 334 of the female terminal 333 shown in FIG. 23, so that the terminals 323*a* and 333 are electrically connected to each other.

The busbar 323 with terminal is formed by stamping an electrically conductive plate and bending. The busbar 323 includes a band-shaped connection part 323*b* as its body and a plurality of tab terminals 323*a* projecting from the connection part 323*b* crossing the connection part 323*b* at right angles. A plurality of the busbars 323 are partially connected, thereby forming a joint circuit.

The cover 322 (see FIG. 21) is formed in a box-shape including frame walls 322*a* and a bottom wall 322*b*. The upper part of the cover 322 is open. After each busbar 323 is mounted on the busbar-receiving part 319, the cover 322 is applied onto the busbar-receiving part 319 from the bottom, thereby preventing the busbars 323 from coming off. The cover 322 and the casing 313 are fixed to each other by engaging a projection and a concave part, for example, thereby the cover 322 is prevented from coming off from the casing 313.

The spacer 337 made of insulating resin has a rectangular shape including the connection part 338 extending straightly in the horizontal direction, a pair of arms 338 continuing to both ends of the connection part 338 crossing at right angles, and a vertical depending wall 340 continuing to one side of the connection part 338 crossing at right angles. A slit 340*a* is formed at a crossing line between the arm 339 and the vertical depending wall 340. The arm 339 can be bent. The back face of the connection part 338 is formed flat and put to the ends of plurality of the joint connectors 325, 325', thereby completely fixing the joint connectors 325, 325'. The inner surface of the vertical depending wall 340 is formed flat and put to the side wall 314*a* at one side of the casing 313. The vertical depending wall 340 is put to the side wall 314*a* of the casing 313, thereby the spacer 337 is prevented from being deformed.

The inner surface at the end side of the arm 339 is provided with an engaging claw 339*a* projecting inwardly. When the spacer 339 faces the side wall 314*a* of the casing 313 and the spacer 339 is put to the side wall 314*a* of the casing 313, the arm 339 is inserted into the cylinder of the frame 316 and the engaging claw 339*a* engages with the projection 316*a* in the cylinder, thereby fixing the spacer 337. Thus, the connection part 338 is put to the ends of a plurality of the joint connectors 325, 325', so that plurality of the joint connectors 325, 325' are completely engaged as a whole, thereby securely fixing the joint connectors 325, 325'.

Figure 23:
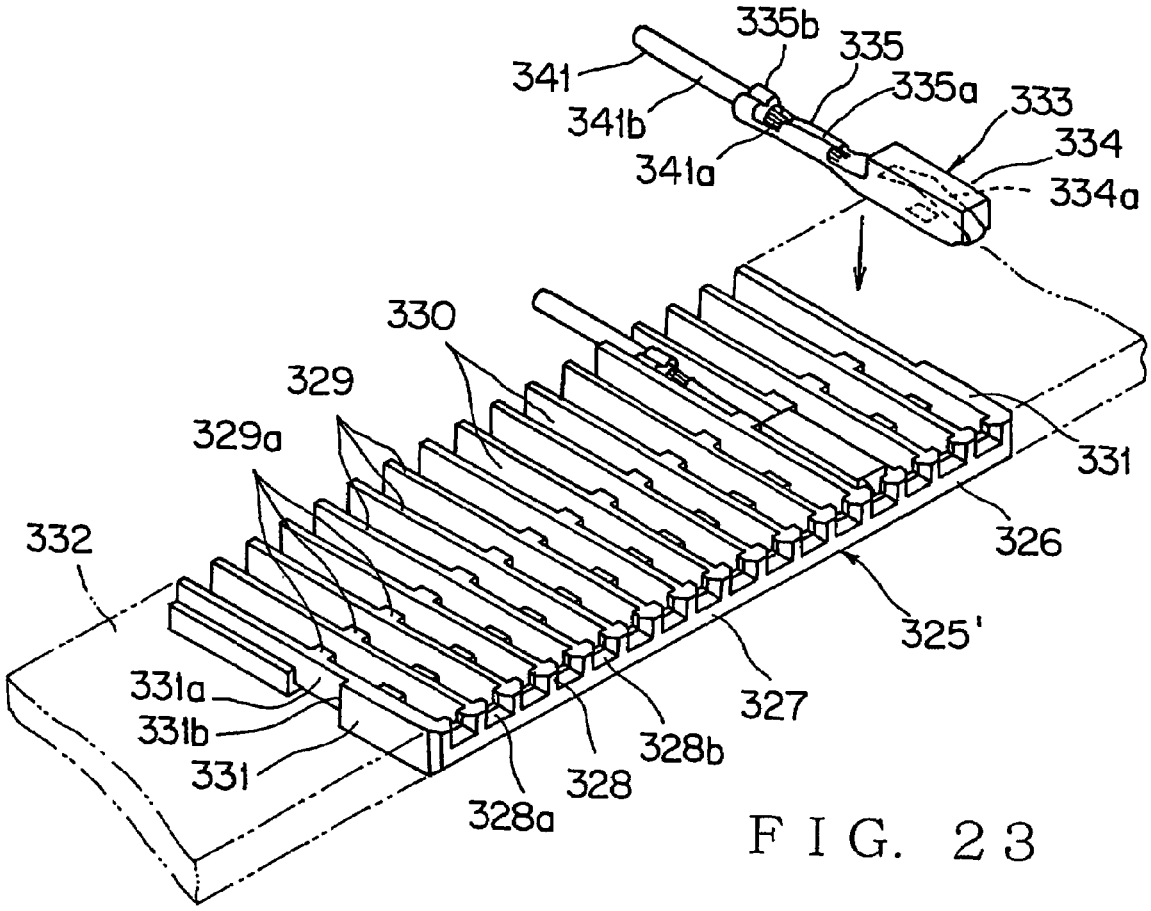
FIG. 23 is a perspective view of the joint connector shown in FIG. 21.
Figure 24:
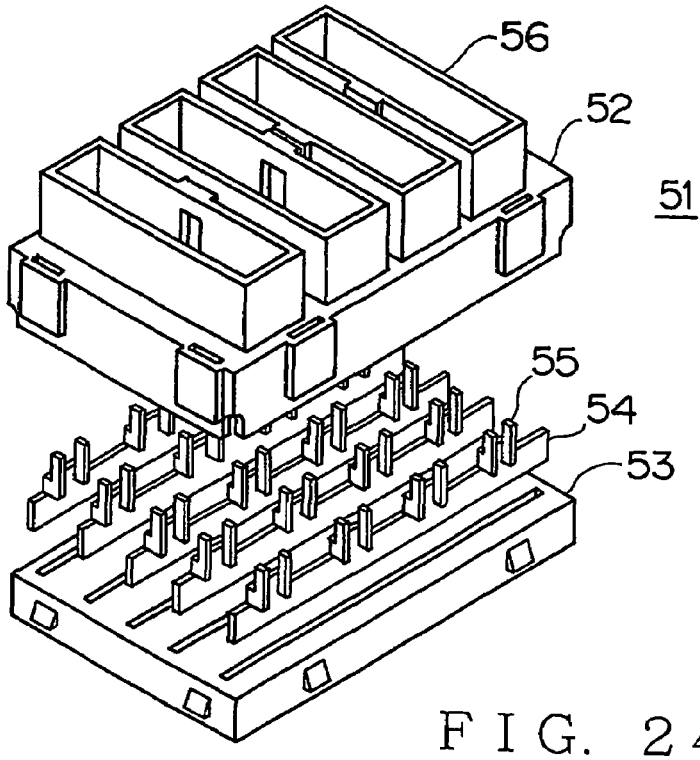
FIG. 24 is an exploded perspective view illustrating an example of a conventional joint connector block.

As shown in FIG. 23, the joint connector 325' (325) includes female terminals 333 to be connected to the tab terminal 323*a* of the busbar 323 and a plate-shaped housing 326. The joint connector 325' and the electric wires 341 to be connected to the female terminal 333 constitute a wiring harness.

The housing 326 made of insulating resin includes a flat board 327, partition walls 329 and front walls 328 standing up crossing at right angles from the board 327. The rear wall and the upper wall facing the board of the housing 326 are formed open. The width of the board 327 is adjusted corresponding to the width of the connector-fitting chamber 318 of the casing 313 so as not to make a gap. A projection 329*a* for preventing the female terminal 333 from coming out is formed at the middle of the partition wall 329. The projection length of the projection 329*a* is formed so as not to obstruct the insertion of the female terminal 333 which is inserted from the top.

A thin and long terminal-receiving part 330 is formed between the adjacent partition walls 329 of the housing 326 so as to receive the female terminal 333 form a direction indicated by an arrow in FIG. 23. The electric contact 334 of the received terminal 333 abuts against the front wall 328 of the housing 326 so as not to come off in the forward direction, while the electric contact 334 abuts against the projection 329*a* so as not to come off in the backward direction. That is, the female terminal 333 received in the terminal-receiving part 330 does not come off from the terminal-receiving part 330.

Insertion holes 328*a* for inserting the tab terminals 323*a* of the busbar 323 are formed in the front walls 328 of the housing 326. The inlet of the hole 328*a* is formed on a tapered surface 328*b*, thereby each tab terminal 323*a* is guided by the tapered surface 328*a* so as to be inserted into the electric contact 334 of the female terminal 333, and clipped by a resilient force of a resilient contact piece 334*a*.

A concave part 331*a* for engaging with the projection 318*c* for the provisional engagement of the connector-fitting chamber 318 is formed on the side walls 331 situated at both sides left and right of the housing 326. The concave part 331*a* is formed in a notch-shape at the middle of the longitudinal direction of the side wall 331. The vertical surface on the front side of the concave part 331*a* is an engaging surface 331*b* for engaging with the projection 318*c*.

In the preferred embodiment as described above, the concave part 331*b* is formed on the side walls 331 situated at both sides. Instead, the concave part 331*b* may be formed on the side wall 331 at one side, partition wall 329 or board 327. If the concave part 331*b* is formed on both side walls 331, the position stability of the joint connector 325' improves.

The housings 326 that are inserted into a plurality of the connector-fitting chambers 318 have the same shape with each other, and are cut and manufactured from a housing material 332, in which the housings 326 are continued in a chain-shape, thereby reducing the cost of the molds and molding and reducing the cost of the joint box 310.

The female terminal 333 is the same as a normal female terminal and is formed by stamping an electrically conductive plate and by bending. The female terminal 333 is provided with a box-shaped electric contact 334 on one side thereof and an electric wire-connecting part 335 on the opposite side thereof. Inside the electric contact 334, a resilient contact piece 334*a* is formed being bent and clips the tab terminal 323*a* of the busbars 323. The electric wire-connecting part 335 includes a pair of crimp-contact pieces 335*a*, 335*b* situated in front and rear, to which a core 341*a* and insulating coating 341*b* of the electric wire 341 are crimp-contacted. The electric wire-connecting part 335 may be a pair of pressure-welding pieces.

INDUSTRIAL APPLICABILITY

According to the invention described in claim 1, each branch terminal of the longitudinal and lateral busbars is arranged in a matrix-shape and connected to a wiring harness and so on, thereby enabling to easily meet a demand of a complicated and highly dense joint circuit form and a demand of a joint circuit form that varies depending on types of a vehicle, increasing the degree of freedom in a circuit designing, enabling to easily respond to a change in the circuit, improving flexibility for various types of a vehicle, and reducing the cost of a joint connector block.

According to the invention described in claim 2, the slit groove positions the longitudinal busbar, while the lateral slit positions the lateral busbar, thereby each longitudinal and lateral busbar is accurately connected without a positional shift and improving the reliability of joint-connection.

According to the invention described in claim 3, since each branch terminal of the longitudinal and lateral busbars is accurately positioned in the concave groove, therefore the branch terminal is accurately connected to a terminal in the outside connector in the connector-fitting chamber without a positional shift, enabling to carry out the connecting process smoothly and securely, and improving the reliability of joint-connection.

According to the invention described in claim 4, each branch terminal of the longitudinal and lateral busbars can be densely arranged being intermingled in a line in the connector-fitting chamber, thereby enabling to make the outside connector thin and to make the joint-connection structure compact.

According to the invention described in claim 5, each branch terminal of the longitudinal and lateral busbars is insulated mutually by the rib in the connector-fitting chamber, thereby preventing a short circuit and preventing a damage due to an interference between the terminals upon assembling of the busbars, and improving the reliability of joint-connection.

According to the invention described in claim 6, the connecting part of the lateral busbar can be easily securely inserted into and connected to the pair of the clip terminals of the longitudinal busbar, and the connecting state of both busbars can be checked by visual observation, thereby improving the workability of the connection process and improving the reliability of joint-connection.

According to the invention described in claim 7, the cover prevents each busbar from slipping off, thereby attaining no need to engage each busbar with the block body and making the structure of the block body simple, compact and low-cost.

According to the invention described in claim 8, the lateral busbar is positioned with the groove of the cover, thereby preventing a positional shift of the lateral busbar relative to the pair of the clip terminals of the longitudinal busbar and preventing wear due to the vibration upon traveling of a vehicle. Further, the rib abuts against the longitudinal busbar, thereby preventing the longitudinal busbar from having back-lash and preventing the longitudinal busbar from wearing against the lateral busbar, and thereby improving the reliability of joint-connection.

According to the invention described in claim 9, the positioning of the lateral busbar is improved and the workability of mounting of the cover is improved.

According to the invention described in claim 10, a laterally linked terminal is cut into a required shape so as to meet a demand of a joint circuit which varies depending on types of a vehicle, thereby enabling to reduce the number of molds for molding busbars (stamping and bending) so as to reduce the cost.

According to the invention described in claim 11, it becomes possible to meet a demand of a circuit of the outside wiring harness, said circuit including a part not to be connected. Further, the branch terminals of the longitudinal and lateral busbars can be highly intermingled, thereby enabling to easily meet a demand of a complicated joint circuit with a low cost.

The invention claimed is:

1. A joint connector block comprising: a block body having a plurality of connector-fitting chambers arranged in a line on one side of the block body, for receiving connectors of at least one outside wiring harness, and a busbar-receiving part communicating with the connector-fitting chambers on an opposite side of the block body;

a plurality of longitudinal busbars, each of which includes at least one branch terminal projecting in the connector-fitting chamber and at least one pair of clip terminals situated on the side of the busbar-receiving part; and a plurality of lateral busbars, each of which includes at least one branch terminal projecting in the connector-fitting chamber and a connecting part to be connected to the pair of the clip terminals on the side of the busbar-receiving part, the lateral busbar being connected to at least two of said longitudinal busbars crossing the longitudinal busbars at right angles;

wherein said branch terminals of said longitudinal busbars and said branch terminals of said lateral busbars are arranged in a line in said connector-fitting chambers for connecting with connectors of the at least one outside wiring harness.

2. The joint connector block as claimed in claim 1, wherein the branch terminal of the longitudinal busbar is offset in a direction crossing at right angles from a connection part from which the pair of the clip terminals protrudes, while the branch terminal of the lateral busbar is on the same plane as that of the connection part of the lateral busbar.

3. The joint connector block as claimed in claim 1, wherein a plurality of ribs are projectingly formed on a partition wall of the connector-fitting chamber, the rib insulating the branch terminals of each said longitudinal or lateral busbar from each other.

4. The joint connector block as claimed in claim 1, wherein each end of the pair of the clip terminals protrudes outward from the busbar-receiving part.

5. The joint connector block as claimed in claim 1, wherein a cover is fitted to the block body and each said longitudinal or lateral busbar abuts against the cover, thereby preventing each busbar from slipping out.

6. The joint connector block as claimed in claim 1, wherein each said longitudinal or lateral busbar is formed by cutting a laterally linked terminal into a required shape.

7. The joint connector block according to claim 6, wherein an unnecessary pair of the clip terminal or branch terminal is cut off from the connecting part of the longitudinal or lateral busbar, and/or the connecting part is cut into a required length or cut at a required position.

8. The joint connector block according to claim 1, wherein the busbar-receiving part includes: a plurality of slit grooves, each of which receives the longitudinal busbar; and a plurality of lateral slits, each of which engages with the connecting part of the lateral busbar, the lateral slit crossing the slit groove at right angles.

9. The joint connector block as claimed in claim 8, wherein the branch terminal of the longitudinal busbar is offset in a direction crossing at right angles from a connection part from which the pair of the clip terminals protrudes, while the branch terminal of the lateral busbar is on the same plane as that of the connection part of the lateral busbar.

10. The joint connector block as claimed in claim 8, wherein a plurality of ribs are projectingly formed on a partition wall of the connector-fitting chamber, the rib insulating the branch terminals of each said longitudinal or lateral busbar from each other.

11. The joint connector block as claimed in claim 8, wherein a cover is fitted to the block body and each said longitudinal or lateral busbar abuts against the cover, thereby preventing each busbar from slipping out.

12. The joint connector block as claimed in claim 8, wherein each said longitudinal or lateral busbar is formed by cutting a laterally linked terminal into a required shape.

13. A joint connector block comprising:

a block body having a plurality of connector-fitting chambers arranged in a line on one side of the block body and a busbar-receiving part communicating with the connector-fitting chambers on an opposite side of the block body;

a plurality of longitudinal busbars, each of which includes at least one branch terminal projecting in the connector-fitting chamber and at least one pair of clip terminals situated on the side of the busbar-receiving part; and a plurality of lateral busbars, each of which includes at least one branch terminal projecting in the connector-fitting chamber and a connecting part to be connected to the pair of the clip terminals on the side of the busbar-receiving part, the lateral busbar being connected to the longitudinal busbar crossing the longitudinal busbar at right angles;

wherein the busbar-receiving part includes:

a plurality of slit grooves, each of which receives the longitudinal busbar; and a plurality of lateral slits, each of which engages with the connecting part of the lateral busbar, the lateral slit crossing the slit groove at right angles; and a concave groove is formed in a partition wall of the connector-fitting chamber continuously from the lateral slit, the branch terminal of each said longitudinal or lateral busbar being inserted through the concave groove.

14. The joint connector block as claimed in claim 13, wherein the branch terminal of the longitudinal busbar is offset in a direction crossing at right angles from a connection part from which the pair of the clip terminals protrudes, while the branch terminal of the lateral busbar is on the same plane as that of the connection part of the lateral busbar.

15. The joint connector block as claimed in claim 13, wherein a plurality of ribs are projectingly formed on a partition wall of the connector-fitting chamber, the rib insulating the branch terminals of each said longitudinal or lateral busbar from each other.

16. The joint connector block as claimed in claim 8, wherein each end of the pair of the clip terminals protrudes outward from the busbar-receiving part.

17. The joint connector block as claimed in claim 13, wherein each end of the pair of the clip terminals protrudes outward from the busbar-receiving part.

18. The joint connector block as claimed in claim 13, wherein a cover is fitted to the block body and each said longitudinal or lateral busbar abuts against the cover, thereby preventing each busbar from slipping out.

19. A joint connector block, comprising a block body having a plurality of connector-fitting chambers arranged in a line on one side of the block body and a busbar-receiving part communicating with the connector-fitting chambers on an opposite side of the block body;

a plurality of longitudinal busbars, each of which includes at least one branch terminal projecting in the connector-fitting chamber and at least one pair of clip terminals situated on the side of the busbar-receiving part; and a plurality of lateral busbars, each of which includes at least one branch terminal projecting in the connector-fitting chamber and a connecting part to be connected to the pair of the clip terminals on the side of the busbar-receiving part, the lateral busbar being connected to the longitudinal busbar crossing the longitudinal busbar at right angles;

wherein a cover is fitted to the block body and each said longitudinal or lateral busbar abuts against the cover, thereby preventing each busbar from slipping out; and the cover includes: a plurality of ribs against each of which an end of each said pair of the clip terminals abuts; and a plurality of grooves, each of which is formed between the ribs, the connection part of the lateral busbar entering in said groove.

20. The joint connector block according to claim 19, wherein said groove is provided with an inclined shaped guide surface on the inlet side of the groove.

* * * * *